US008602513B2

(12) United States Patent
Ara et al.

(10) Patent No.: US 8,602,513 B2
(45) Date of Patent: Dec. 10, 2013

(54) INKJET PRINTING APPARATUS

(75) Inventors: Yohji Ara, Yokohama (JP); Shigeru Watanabe, Yokohama (JP); Naoaki Wada, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 617 days.

(21) Appl. No.: 12/717,644

(22) Filed: Mar. 4, 2010

(65) Prior Publication Data

US 2010/0231662 A1 Sep. 16, 2010

(30) Foreign Application Priority Data

Mar. 10, 2009 (JP) ..... 2009-056901

(51) Int. Cl.
*B41J 2/195* (2006.01)
*B41J 2/175* (2006.01)

(52) U.S. Cl.
USPC ..... 347/7; 347/85

(58) Field of Classification Search
USPC ..... 347/7, 85
See application file for complete search history.

(56) References Cited

U.S. PATENT DOCUMENTS

| | | | | |
|---|---|---|---|---|
| 4,951,066 | A | 8/1990 | Terasawa et al. | 346/140 R |
| 5,138,343 | A | 8/1992 | Aichi et al. | 346/140 R |
| 5,357,275 | A | 10/1994 | Ikado et al. | 347/31 |
| 5,717,444 | A | 2/1998 | Sugimoto et al. | 347/29 |
| 6,447,084 | B1 | 9/2002 | Uetsuki et al. | 347/7 |
| 6,474,797 | B2 | 11/2002 | Kurata et al. | 347/85 |
| 6,540,321 | B1 | 4/2003 | Hirano et al. | 347/22 |
| 6,629,758 | B2 | 10/2003 | Okamoto et al. | 347/85 |
| 6,637,872 | B2 | 10/2003 | Ara et al. | 347/85 |
| 6,755,500 | B2 | 6/2004 | Hirano et al. | 347/22 |
| 2007/0058012 | A1 | 3/2007 | Watanabe | 347/86 |
| 2007/0109362 | A1 * | 5/2007 | Hori et al. | 347/65 |
| 2008/0105351 | A1 | 5/2008 | Shepherd | 152/517 |
| 2008/0198207 | A1 * | 8/2008 | Katada | 347/85 |
| 2008/0297569 | A1 * | 12/2008 | Umeda | 347/85 |
| 2009/0201347 | A1 * | 8/2009 | Hamano | 347/85 |

FOREIGN PATENT DOCUMENTS

| | | | |
|---|---|---|---|
| JP | 2001-113716 | 4/2001 | |
| JP | 2003-001846 | * 1/2003 | 347/85 |
| JP | 2004-358918 | * 12/2004 | 347/85 |
| JP | 2006-192758 | 7/2006 | |
| JP | 2007-106104 | 4/2007 | |
| JP | 2008-105351 | 5/2008 | |

* cited by examiner

*Primary Examiner* — Julian Huffman
(74) *Attorney, Agent, or Firm* — Fitzpatrick, Cella, Harper & Scinto

(57) ABSTRACT

A printing apparatus configured to perform printing by supplying an ink from a main tank to a sub tank and ejecting the ink in the sub tank from a printing head is allowed to execute an agitating operation to appropriately eliminate sedimentation of a pigment component without being complicated in structure and increased in cost. The printing apparatus includes a diaphragm provided in an ink supply path, and a driving mechanism for driving the diaphragm to thereby change an internal volume thereof. In the ink supply path, a resistance value of a flow path from the diaphragm to the printing head is set greater than that of a flow path from the diaphragm to the sub tank. The diaphragm is driven to generate bidirectional ink flow between the diaphragm and the sub tank to eliminate pigment component sedimentation at a bottom of the sub tank.

8 Claims, 17 Drawing Sheets

INKJET PRINTING APPARATUS

BACKGROUND OF THE INVENTION

1. Field of the Invention

The present invention relates to an inkjet printing apparatus configured to perform printing by ejecting liquid onto a printing medium.

2. Description of the Related Art

In recent years, application of inkjet printing apparatuses has been diversified into printing of photographic images on sheets large in size such as A1 size or A0 size. In such application, a large amount of ink is required for printing on a single printing medium. Meanwhile, an inkjet printing apparatus widespread in general for private use is relatively small in size, and includes an ink tank detachably or non-detachably integrated with a printing head. When using such an ink tank, a printing apparatus requires more frequent replacement of the ink tank and thus requires more time and efforts for its handling than ever before. Meanwhile, a large-capacity ink tank may be employed in order to reduce the frequency of ink tank replacement. In this case, however, the ink tank including the ink contained therein has such a large weight that power consumption required for moving the printing head is increased.

Accordingly, in an inkjet printing apparatus suitable for the above-described application, it is advantageous to employ a so-called tube supply method in which a large-capacity ink tank separate from a printing head is disposed at a fixed position on an apparatus, and ink is supplied through a tube which connects the printing head and the ink tank. Specifically, even when the large-capacity ink tank is employed, the ink tank does not have to be moved together with the printing head. Hence, it is possible to reduce the weight of the moving part and thereby to suppress power consumption at the time of printing. Moreover, being provided with a relatively large-capacity ink tank in order to perform printing, a printing apparatus using the tube supply method can perform continuous printing for a long period of time. As described above, the tube supply method allowing continuous printing for a long period of time is employed in some cases when a serial scanning type of inkjet recoding apparatus needs to be equipped with a large-capacity ink tank in order to output printed images large in size.

However, even in the case of the above-described printing apparatus employing the tube supply method, the ink tank has a limited amount of ink thereinside. Accordingly, it is necessary to replace the ink tank when the ink inside the ink tank is exhausted. Moreover, if the ink inside the ink tank is exhausted during a printing operation of a single printing medium, it is necessary to stop the printing operation and to replace the empty ink tank. In this case, the ink ejected onto the printing medium gets dried during replacement of the ink tank. As a result, when the printing operation is resumed, a color difference (unevenness of color) may appear between a printed portion formed immediately after resuming of the printing operation and the other portions. Such a color difference is apt to appear when inks in different colors are ejected onto the same position on the printing medium in an overlapping manner. Specifically, when the printing operation is performed continuously without interruption, a time gap between an ink ejected earlier and an ink ejected later is not so large. Accordingly, the ink ejected later is ejected on and thus overlaps the undried ink ejected earlier. Therefore, the inks in different colors ejected onto the same position in the overlapping manner are mixed together on the printing medium. On the other hand, if the printing operation is temporally stopped by replacement of the ink tank, the liquid ink is ejected on and thus overlaps the dried ink, and those inks are not mixed together properly. As a consequence, a portion printed immediately after replacement of the ink tank exhibits a color in which a color of either the ink ejected earlier or the ink ejected later is emphasized more. Thus, the color difference appears between the printed portion which is printed continuously and the portion where the printing is resumed after the interruption due to replacement of the ink tank.

The unevenness of color caused by interruption for replacing the ink tank as described above causes a significant adverse effect on image quality of the printing apparatus capable of large size printing at a high speed by using a long printing head, for example. Meanwhile, when a printed image cannot be used as a product due to occurrence of unevenness of color, the inks and the printing medium are wasted and running costs are thereby increased. To avoid this, Japanese Patent Laid-Open No. 2001-113716 proposes an inkjet printing apparatus using a sub tank in addition to a main tank in order to avoid a situation in which an ink tank needs to be replaced during a printing operation on a printing medium. In the inkjet printing apparatus disclosed therein, an ink is supplied from a replaceable large-capacity main tank to a relatively small-capacity sub tank, and the ink stored in the sub tank is supplied to a printing head.

Therefore, even when the ink inside the main tank is exhausted during printing on a single printing medium, ink still remains inside the sub tank, so that the printing can be continued by using the ink stored in the sub tank. Then, replacement of the main ink tank is completed while the printing is being performed by use of the ink supplied from the sub ink. Thus, the printing operation can be performed without interruption, and the high quality of the printed image can be maintained.

According to the printing apparatus disclosed in Japanese Patent Laid-Open No. 2001-113716, the printing head and the sub tank are mounted on a carriage. Moreover, the main tank is disposed in a position separate from the carriage, and an ink flow path is disposed to extend from the main tank to the sub tank. The ink flow path extending from the main tank to the sub tank is connectable to and disconnectable from the sub tank. The ink flow path extending from the main tank is provided with a pump for supplying the ink from the main tank to the sub tank.

As described above, according to the printing apparatus of Japanese Patent Laid-Open No. 2001-113716, the pump is disposed in the ink flow path between the main tank and the sub tank, and the ink is supplied from the main tank to the sub tank by use of this pump. However, the pump for supplying the ink from the main tank to the sub tank is often expensive. In general, the pump requires various structures including a driving source, a transmission mechanism for transmitting a driving force generated by the driving source, the ink flow path, and the like. For this reason, the pump is relatively costly among components included in a printing apparatus. Moreover, the printing apparatus configured to supply the ink from the main tank to the sub tank also needs an exhaust mechanism. The exhaust mechanism has to be equipped with a pump or a valve which allows the sub tank to communicate with or to be blocked from atmosphere and a driving mechanism for driving the valve, for example. Therefore, the configuration of the exhaust mechanism is likely to be complicated and costly.

Meanwhile, ink used for inkjet printing is classified broadly into an ink mainly containing a dye component as a coloring material (hereinafter referred to as a dye ink) and an ink mainly containing a pigment component (hereinafter referred to as a pigment ink). For an application that requires light resistance or gas resistance of a printed material, use of the pigment ink, particularly, is often effective in ensuring sufficient fastness of an image. However, the pigment ink has various problems in handling as compared to the dye ink. Dispersibility of the pigment component being the coloring material in the ink is one of the problems, for example. The pigment component is not dissolved in an ink solution unlike the dye component but is floating in the fluid in a dispersed state. Accordingly, if no printing operation takes place for a while, pigment particles inside the ink tank gradually settle out due to gravity, thereby causing a difference in density distribution of the pigment particles in the vertical direction of the ink tank. Specifically, a layer having a high coloring material density is formed in a lower portion while a layer having low coloring material density is formed in an upper portion. If the printing operation is started and continued in this state, a density difference occurs on an outputted image.

To solve this problem, it is effective to cause a flow or a movement of the ink inside the tank by increasing or reducing the pressure of an ink supply path such as a tube, thereby performing an agitating operation of the ink inside the ink tank. In this case, it is desirable to achieve a state of a small difference in the density distribution (a state of uniform dispersion of the coloring material) inside the tank by performing a preferable agitating operation without causing structural complication of the printing apparatus.

SUMMARY OF THE INVENTION

An object of the present invention is to provide an inkjet printing apparatus capable of performing an appropriate agitating operation without being complicated in structure and increased in cost, the inkjet printing apparatus configured to supply liquid from a main tank to a sub tank and to perform printing by ejecting the liquid inside the sub tank from a printing head.

To this end, in an aspect of the present invention, there is provided an inkjet printing apparatus comprising:

a first ink tank configured to contain an ink to be supplied to a printing head performing printing by ejecting the ink;

a second ink tank located between the first ink tank and the printing head and configured to temporarily store the ink to be supplied from the first ink tank to the printing head;

an air communication valve capable of opening and closing a communicating portion allowing an inside of the second ink tank to communicate with the atmosphere;

a variable volume member located in an ink supply path between the second ink tank and the printing head and being capable of changing an internal volume thereof; and a driving mechanism configured to drive the air communication valve to thereby open and close the air communication valve, and to drive the variable volume member to thereby generate a change in the internal volume thereof, wherein in the ink supply path, a resistance value of a flow path from the variable volume member to the printing head is greater than a resistance value of a flow path from the variable volume member to the second ink tank, and the driving mechanism generates bidirectional flow of the ink between the variable volume member and the second ink tank by driving the air communication valve to open or to close the air communication valve and then driving the variable volume member to change the internal volume thereof.

According to the present invention, it is possible to provide an inkjet printing apparatus capable of performing an appropriate agitating operation without being complicated in structure and increased in cost, the inkjet printing apparatus configured to supply a liquid from a main tank to a sub tank and to perform printing by ejecting the liquid inside the sub tank from a printing head.

Further features of the present invention will become apparent from the following description of exemplary embodiments (with reference to the attached drawings).

DESCRIPTION OF THE EMBODIMENTS

Embodiments of the present invention will be described below with reference to the accompanying drawings.

(Basic Configuration)

Figure 1:
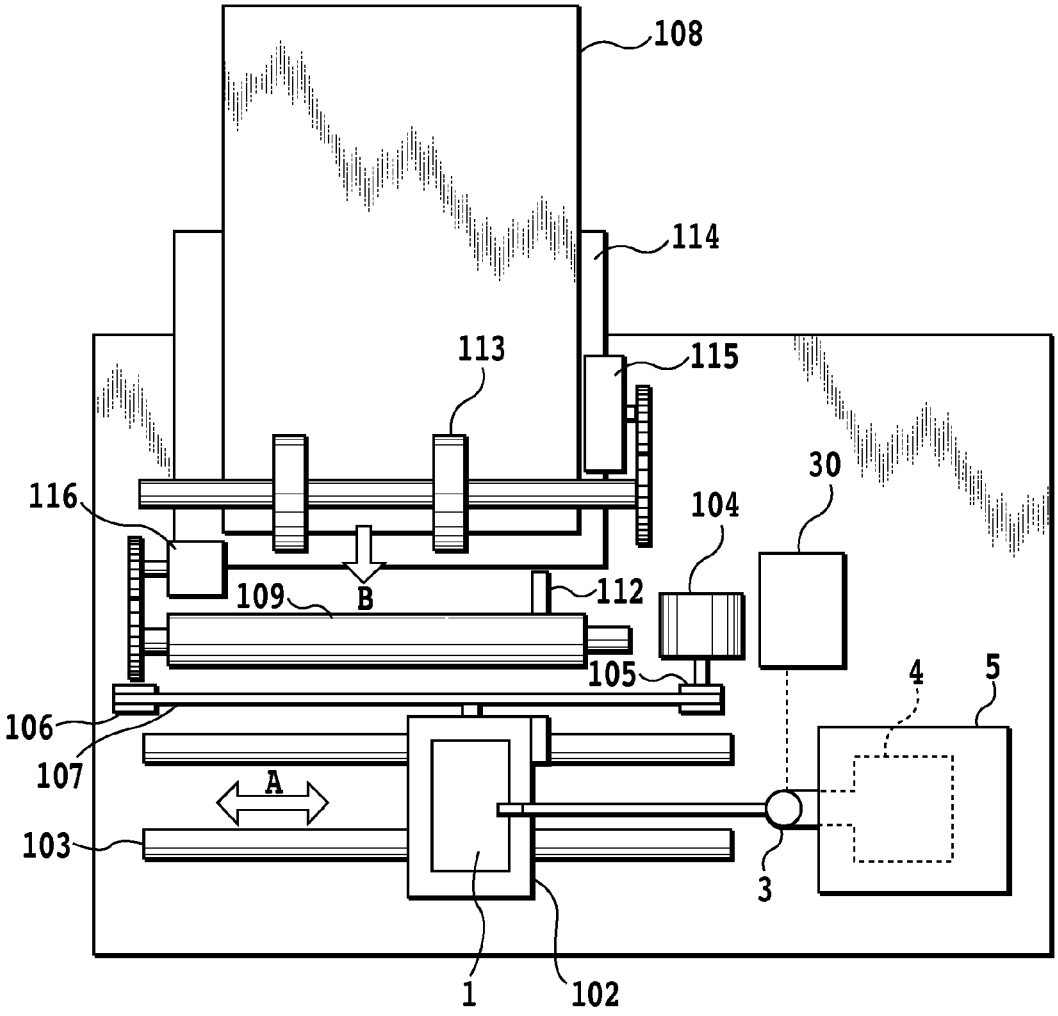
FIG. 1 is a plan view of an inkjet printing apparatus according to a first embodiment of the present invention.

FIG. 1 is a schematic plan view for explaining an outline configuration of an inkjet printing apparatus employing the present invention. Note that the inkjet printing apparatus illustrated herein is a so-called serial-type inkjet printing apparatus. Such an apparatus is configured to perform printing while moving a printing head, which is capable of ejecting ink droplets, in an intersecting direction relative to a conveying direction of a printing medium.

In FIG. 1, a printing head 1 is an inkjet printing head which is capable of ejecting a supplied ink out of multiple ejection ports. This printing head 1 is detachably mounted on a carriage 102. The carriage 102 is provided with a connector holder (an electric connector unit) configured to transmit driving signals and the like to the printing head 1 through an unillustrated connector. The carriage 102 is supported by a guide shaft 103 installed in an apparatus body to be reciprocable in directions indicated with an arrow A. A timing belt 107 connected to the carriage 102 is wound between a driven pulley 106 and a motor pulley 105 configured to be driven and rotated by a motor (hereinafter referred to as a main scanning motor) 104 serving as a driving source of the reciprocating movement. The carriage 102 is carried in the A directions by a driving mechanism formed of the motor 104, the pulleys 105 and 106, the timing belt 107, and so forth.

A printing medium 108 such as a print sheet or a plastic thin plate is fed one-by-one separately from an automatic sheet feeder (ASF) 114 by rotating a pickup roller 113 with a drive of a sheet feed motor 115. Moreover, the printing medium 108 is conveyed in a direction of an arrow B by rotation of a conveyor roller 109 and is passed through a position (a printing portion) opposed to a surface (an ejection opening surface) formed with the ejection openings on the printing head 1. The conveyor roller 109 is rotated by driving a conveyor motor 116. A judgment as to whether the printing medium 108 is fed and determination of a position of a leading end of the printing medium at the time of feeding are performed based on a detection signal from a paper end sensor 112 located upstream of the conveyor roller 109. Moreover, the paper end sensor 112 is also used for determination of a trailing end of the printing medium 108 and for determination of a current printing position based on the trailing end of the printing medium 108. Here, a back surface of the printing medium 108 is supported by a platen (not shown) so that a flat printing surface is formed in the printing portion.

In the inkjet printing apparatus having the above-described configuration, an image is formed on the printing medium by repeating a printing operation to cause the printing head 1 to eject the ink while moving in the A direction together with the carriage 102 (such an operation will be hereinafter referred to as printing scan) and a conveying operation of the printing medium carried out between each two consecutive printing scan sessions.

Figure 2:
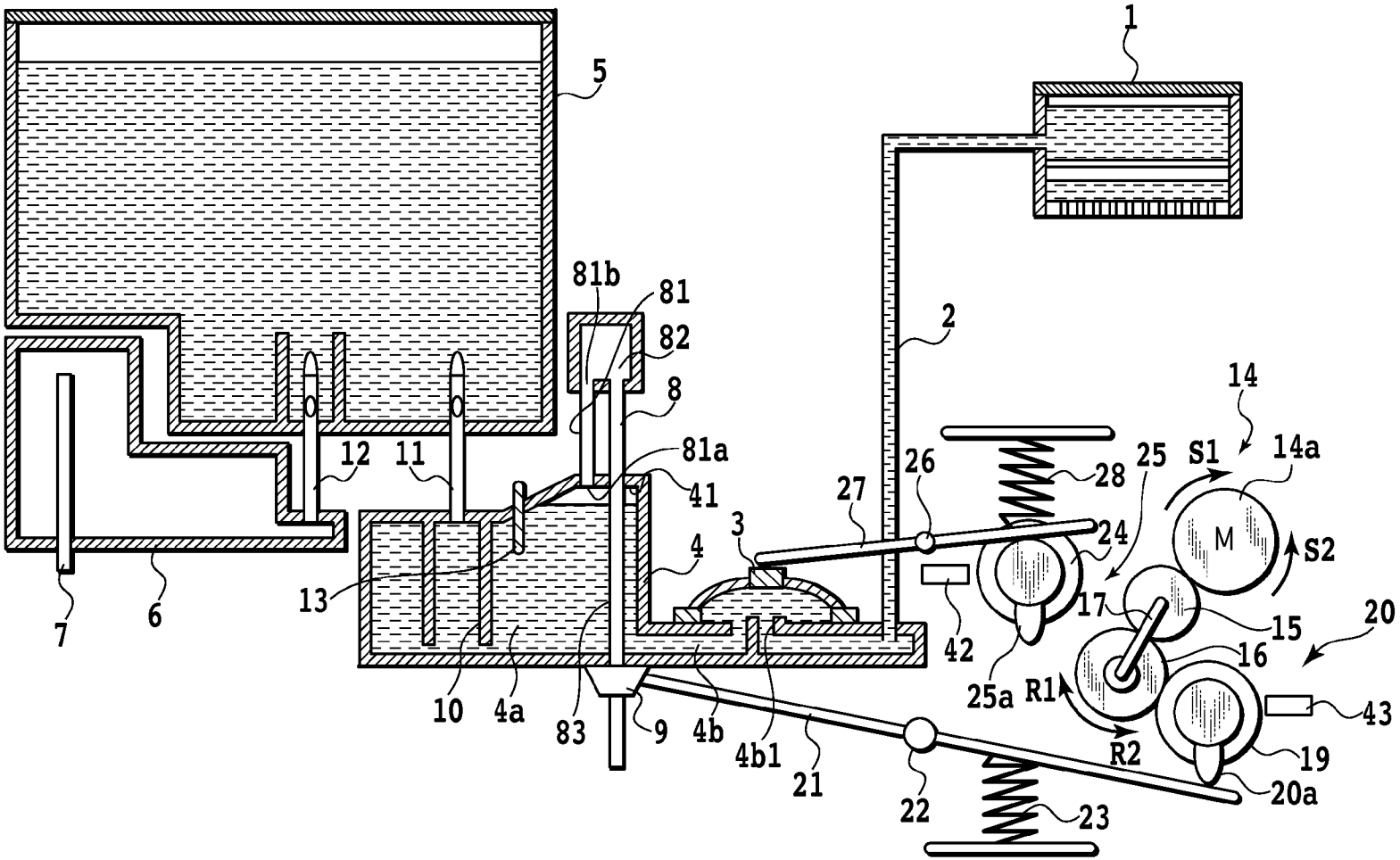
FIG. 2 is a schematic cross-sectional view showing an expanded state of a diaphragm portion in an ink supply system for supplying ink to a printing head.

FIG. 2 is a schematic diagram of an ink supply system of an inkjet printing apparatus 100 according to the embodiment of the present invention. To simply the explanation, only a path for a liquid represented by an ink corresponding to one color is indicated herein. In particular, FIG. 2 is the view showing a state where a sufficient amount of ink is filled in a main tank 5 and a printing operation is carried out by use of the ink inside the main tank 5.

First, a configuration of the ink supply system of this embodiment will be described. The ink supply system of this embodiment includes the printing head 1, the main tank 5, a sub tank 4, and a buffer chamber 6. The printing head 1 of this embodiment includes an element substrate provided with printing elements for ejecting the ink, and an orifice plate bonded to this element substrate. The orifice plate includes multiple ejection openings for ejecting the ink droplets. Moreover, the orifice plate is provided with bubbling chambers serving as energy generating chambers communicated with the ejection openings as a result of being bonded to the element substrate, ink flow paths to be communicated with the bubbling chambers, and so forth.

The main tank (a first ink tank) 5 is detachably mounted on a printing apparatus body. In this embodiment, the main tank 5 is formed to be capable of containing a relatively large amount of the ink. The ink contained in the main tank 5 is supplied to the sub tank 4 mounted on the printing apparatus body and the ink inside the sub tank is supplied to the printing head 1 mounted on the carriage. The printing head 1 ejects the supplied ink from the ejection openings to perform image printing. As the printing operation progresses, the ink is supplied from the main tank to the sub tank and the ink inside the main tank 5 is decreased. Then, when the ink inside the main tank becomes empty or when the amount of the ink left therein is insufficient for printing on a single printing medium, the main tank 5 is replaced with a new main tank 5 filled with the ink.

The sub tank 4 (a second ink tank) 4 is located between the main tank 5 and the printing head 1 to be capable of temporarily storing the ink supplied from the main tank 5 to the printing head 1. This sub tank 4 contains a sufficient amount of the ink for performing the printing operation while replacing the main tank 5 so as not to interrupt the printing operation while replacing the empty main tank. For this reason, a capacity of the sub tank 4 is relatively smaller than a capacity of the main tank 5. The main tank 5 and the sub tank 4 are communicated with each other by use of a first hollow pipe 11 formed in a manner protruding from an upper surface portion of the sub tank 4. The first hollow pipe 11 is made of a conductive material such as metal and is formed to allow communication of the ink inside.

Here, the first hollow pipe 11 has a sufficiently small inner diameter so that a flow path used for communication of the ink has a sufficient flow resistance. For this reason, even when the main tank 5 is located in a position higher than the sub tank 4, the ink contained in the main tank 5 is not supplied to the sub tank 4 only by gravity. The ink is supplied from the main tank 5 to the sub tank 4 when a negative pressure equal to or above a predetermined value is generated inside the sub tank 4 along with a decrease in the amount of the ink inside the sub tank 4 as a result of ejection of the ink from the printing head 1.

Meanwhile, a supply tube 2 is disposed between the printing head 1 and the sub tank 4 in order to connect these constituents to each other. The supply tube 2 allows flow of the ink inside thereof and supplies the ink in the sub tank 4 to the printing head 1. The supply tube 2 is made of a soft material and is able to supply the ink to the printing head 1 while allowing the printing head 1 to perform the printing scan.

An air communication path 8 that allows air communication with the outside is connected to the sub tank 4. The air communication path 8 includes an introduction part 81, a space part 82, and a discharge part 83. The introduction part 81 is formed upright from the highest position 41 inside the sub tank 4. The space part 82 is formed to be connected to an emission port 81*b* formed on an upper end of the introduction part 81. The discharge part 83 is formed downward from the space part 82 to a position below a bottom surface of the sub tank 4. The air communication path 8 is formed into an inverted U-shape as a whole. An introduction port 81*a* formed at a lower end portion of the introduction part 81 is located at a height which is the same that of the highest position inside the sub tank 4. Meanwhile, the air communication path 8 is provided with an air communication valve 9 which is slidable along an outer peripheral surface of the discharge part 83. It is possible to open and close an air communication port (an air communicating portion) 8*a* serving as an exit of the air communication path 8 by moving this air communication valve 9. Therefore, when the air communication port 8*a* is in an open state, it is possible to discharge the air inside the sub tank 4 to the outside through the introduction part 81, the space part 82, and the discharge part 83.

Moreover, a solid rod 13 is fitted to the sub tank 4. The solid rod 13 is made of a conductive material such as metal and is configured to touch the ink when a liquid level of the ink inside the sub tank 4 is at a predetermined level or higher. This solid rod 13 is electrically connected to the hollow pipe 11 by use of unillustrated wiring. Accordingly, a closed circuit is formed when the solid rod 13 and the hollow pipe 11 contacts the ink contained inside the sub tank whereby an electric signal indicating that the ink is filled in the sub tank is outputted.

In this embodiment, the solid rod 13 is located on an inclined surface 42 formed on the upper surface of the sub tank 4 so as to avoid bubbles generated inside the ink in the sub tank 4 to stay around the solid rod 13. In this way, it is possible to avoid occurrence of a detection failure that the position of the liquid level is not detected because the ink does not contact the solid rod 13 due to the bubbles staying around the solid rod 13.

Figure 3:
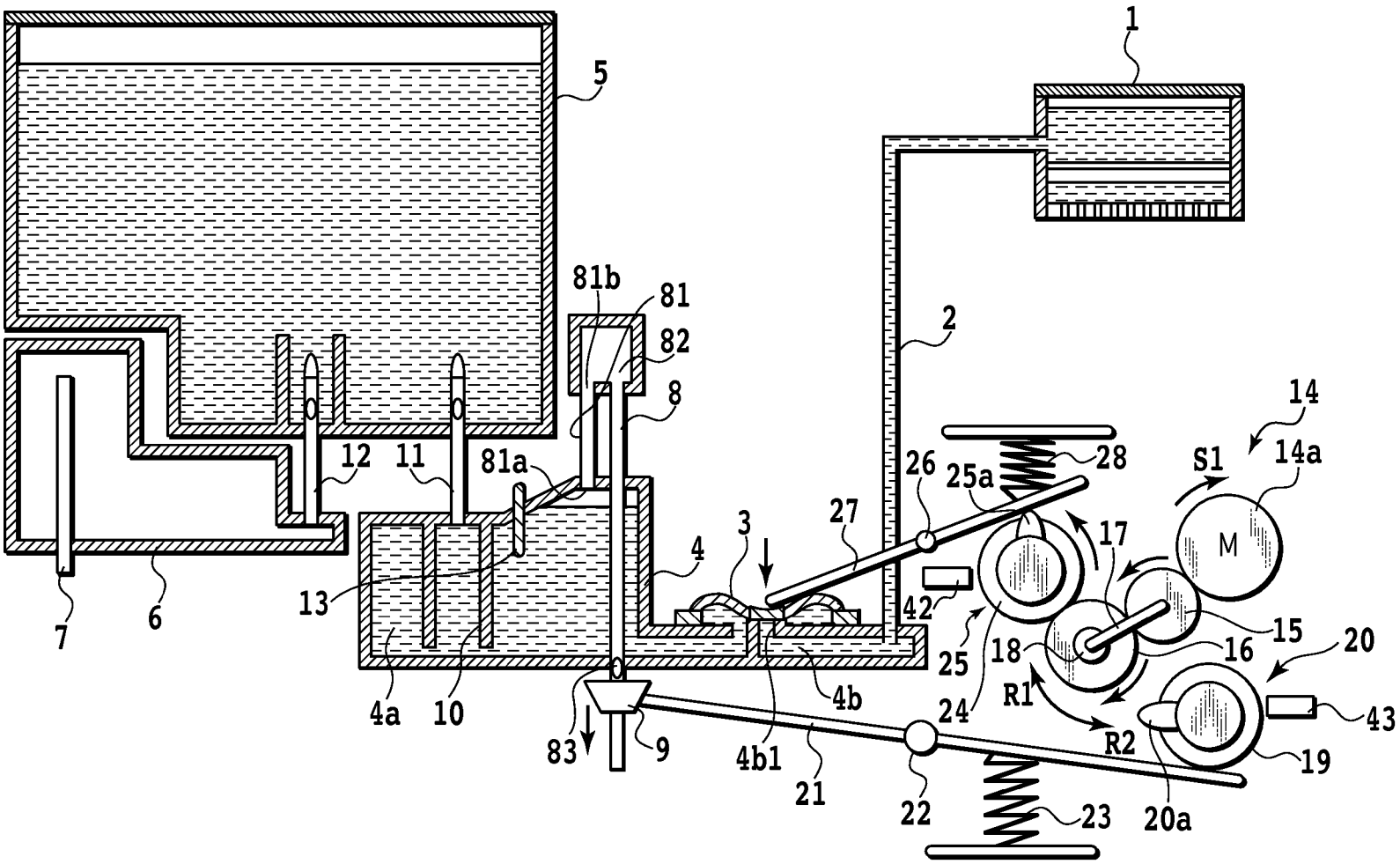
FIG. 3 is a schematic cross-sectional view showing a contracted state of the diaphragm portion in the ink supply system for supplying the ink to the printing head.

Moreover, a diaphragm portion 3 capable of changing an internal volume is provided on the way of an ink supply path between the sub tank 4 and the printing head 1. In this embodiment, the diaphragm portion 3 is located in a flow path portion 4*b* communicated with a liquid chamber portion 4*a* of the sub tank 4. The diaphragm portion 3 is formed of a rubber diaphragm having flexibility. FIG. 2 shows an initial state where the diaphragm portion 3 bulges out of a wall surface of the flow path portion 4*b* and the internal volume of the diaphragm portion 3 is expanded. On the other hand, FIG. 3 shows a state where a central part of the diaphragm portion 3 is pressed to contact the wall surface of the flow path portion 4*b*. In this state, the internal volume of the diaphragm portion 3 is reduced as compared to the above-described expanded state. Here, in the flow path portion 4*b* in this embodiment, a communication port 4*b*1 opened and closed by the diaphragm portion 3 is formed. A lower end portion of the above-described supply tube 2 is connected to a position downstream of the communication port 4*b*1 (downstream in terms of a direction of flow of the ink from the sub tank to the printing head). Therefore, when the diaphragm portion 3 is pressed as shown in FIG. 3, the communication port 4*b*1 is closed by the diaphragm portion 3 so that the communication between the liquid chamber portion 4*a* and the printing head 1 can be shut off. In other words, the diaphragm portion 3 also has a function as an on-off valve that allows or prohibits communication between the printing head 1 and the liquid chamber portion 4*a*.

Meanwhile, the flow path portion 4*b* where the diaphragm portion 3 is provided is disposed at a lower portion of the liquid chamber portion 4*a* of the sub tank 4, and a communication port with the liquid chamber portion 4*a* is formed at a relatively low position. In this way, the air does not flow into the flow path portion 4*b* and the diaphragm portion 3 until the ink remaining inside the sub tank 4 becomes scarce due to consumption of the ink.

The buffer chamber 6 is formed as a container that can contain the ink inside thereof and is configured to communicate with the main tank 5. Moreover, an air communication path 7 opened to the atmosphere is disposed inside the buffer chamber 6 whereby a space inside the buffer chamber is communicated with the atmosphere through the air communication path 7. The main tank 5 is connected to the buffer chamber 6 by use of a second hollow pipe 12. The second hollow pipe 12 is also made of a conductive material such as metal and is formed to allow communication of the ink inside thereof. Since the main tank 5 is communicated with the buffer chamber 6, even when the ink inside the main tank 5 expands due to a rise in temperature thereby increasing a pressure inside the main tank 5, it is possible to feed the ink inside the main tank 5 into the buffer chamber 6. Accordingly, it is possible to suppress an excessive increase in the pressure inside the main tank 5. Moreover, the main tank 5 is formed to communicate with the atmosphere through the buffer chamber 6. Hence the buffer chamber plays a role to achieve a balance between the pressure inside the main tank 5 and the atmospheric pressure.

Here, a mechanism configured to perform pressing and releasing operations of the diaphragm portion 3 and opening and closing operations of the air communication valve in this embodiment will be described. In this embodiment, expanding and contracting operations of the internal volume of the diaphragm portion 3 by means of pressing and releasing the diaphragm portion 3 as well as the opening and closing operations of the air communication port are achieved by a driving mechanism 30 having a single motor 14. The driving mechanism 30 includes a driving force transmission mechanism having the motor 14, a driving gear 14*a* fixed to an output shaft of the motor 14, an idle gear 15, and a planetary gear 16. Moreover, the driving mechanism 30 includes a first gear 19 and a second gear 24 which are selectively rotated by the driving force transmission mechanism, a first cam 20 rotated together with the first gear 19, and a second cam 25 rotated together with the second gear 24. Further, the driving mechanism 30 includes an air valve lever 21 operated by the first cam 20 and a diaphragm lever 27 operated by the second cam 25.

To be more precise, the driving gear 14*a* fixed to the output shaft of the motor 14 is disposed to be engaged with the idle gear 15. Meanwhile, the idle gear 15 is engaged with the planetary gear 16 and the gears transmit the driving force from the motor 14. The planetary gear 16 is connected to the idle gear 15 through an arm 17 so that the planetary gear 16 can move either in a direction R1 or a direction R2 as shown in FIG. 2 depending on a direction of rotation of the motor 14 while maintaining a constant distance from a central axis of the idle gear 15. The planetary gear 16 engages with the gear 24 when the planetary gear 16 moves in the direction R1. On the other hand, the planetary gear 16 engages with the gear 19 when the planetary gear 16 moves in the direction R2.

Moreover, the driving mechanism 30 includes the air valve lever 21 to be rotated about a fulcrum 22, and the diaphragm lever 27 to be rotated about a fulcrum 26. One end portion of the air valve lever 21 is connected to the air communication valve 9 for opening and closing the above-described air communication port 8*a* and is biased to a position to open the air communication port 8*a* by a biasing force of a compression spring 23. A pressing portion 20*a* protruding outward is provided at a part of an outer periphery of the cam 20. This pressing portion 20*a* presses another end portion of the air valve lever 21 against the biasing force of the compression spring 23 as the cam 20 is rotated to a predetermined phase position. Meanwhile, a pressing portion 25*a* protruding outward is provided at a part of an outer periphery of the cam 25. This pressing portion 25*a* presses one end portion of the diaphragm lever 27 against a biasing force of a compression spring 28 as the cam 25 is rotated to a predetermined phase position. Sensors 42 and 43 configured to perform phase detection of the cam 25 and the cam 20 rotated together with the gear 24 and the gear 19 are disposed respectively in positions close to the gear 24 and the gear 19. Of these sensors, the diaphragm portion sensor 42 performs detection of the phase of the cam 25 configured to press the diaphragm lever 27 for operating the diaphragm portion 3 by using the pressing portion 25*a*. Meanwhile, the air valve sensor 43 performs detection of the phase of the cam 20 configured to press the air valve lever 21 for operating the air communication valve 9 by using the pressing portion 20*a*. The phases of the respective gears 24 and 19 are accurately detected with the sensors 42 and 43 so that the opening and closing operations of the air communication port and the expanding and contracting operations of the internal volume of the diaphragm portion 3 by means of the movement of the diaphragm portion 3 can be performed reliably. In this embodiment, optical photosensors including light emitting elements and light receiving elements are applied as the sensors 42 and 43. The sensors 42 and 43 detect the phases of the gears 24 and 19 by detecting amounts of light with the light receiving elements. In this embodiment, flags are provided in predetermined positions of the gears 19 and 42, respectively. When each of the flag is located at a predetermined phase, the flag shields the light from the light emitting element, and amounts of light detected by the corresponding light receiving element changes. Thus, phases of the gears 19 and 24 are detected. It is to be noted that the form of the sensors 42 and 43 is not limited only to the foregoing configuration and other forms are also applicable. For example, it is also possible to use a magnetic sensor configured to detect a change in a magnetic field which is generated when a gear passes a position near the sensor.

Figure 9:
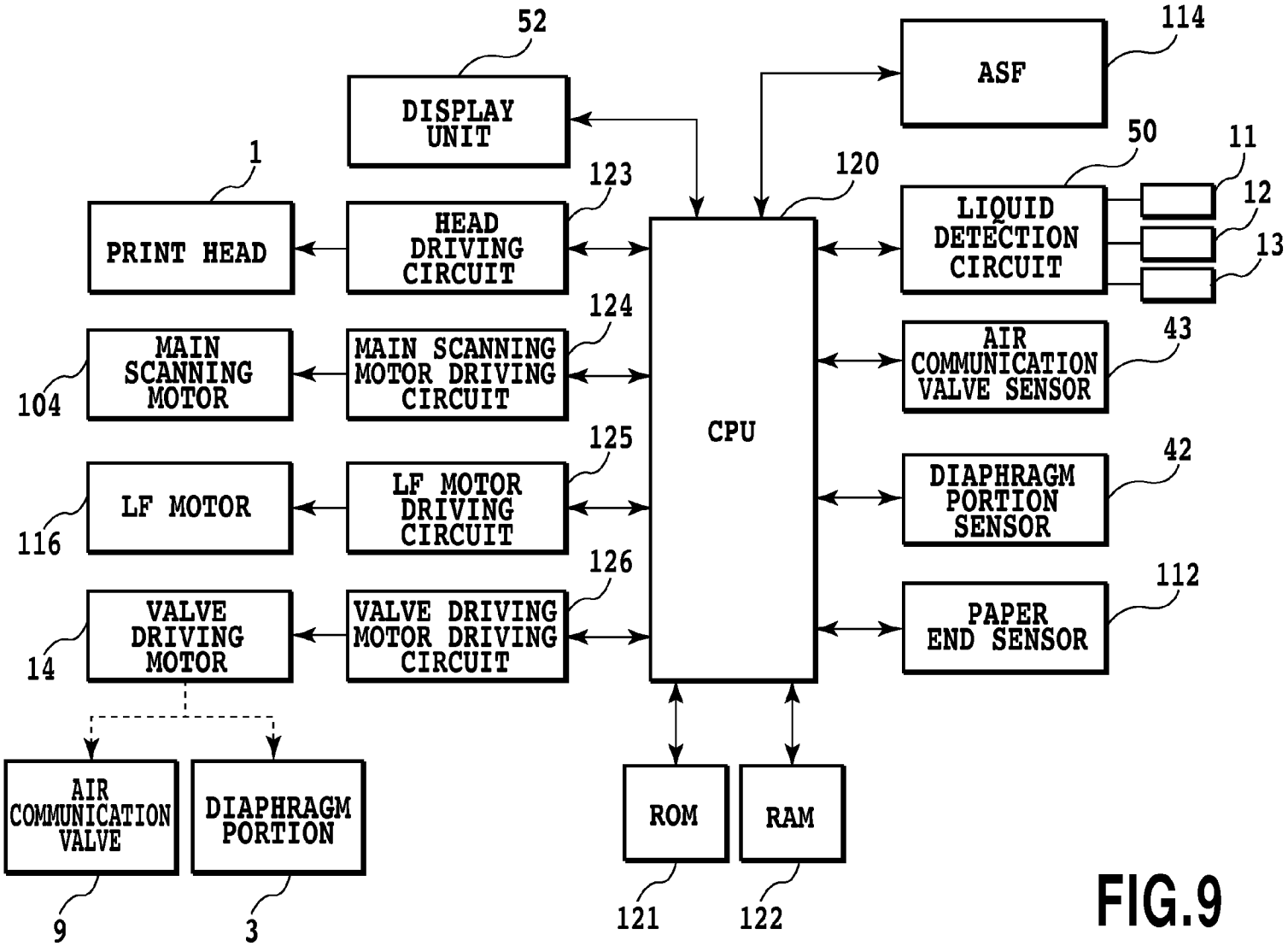
FIG. 9 is a block diagram showing a configuration example of a control system of the inkjet printing apparatus.

FIG. 9 is a block diagram showing an outline configuration of a control system of the inkjet printing apparatus of this embodiment. In FIG. 9, operations of the respective constituents of the inkjet printing apparatus are controlled by a CPU 120 on the basis of control programs stored in a ROM 121, various data stored in a RAM 122, and the like. Specifically, a head driving circuit 123 configured to drive electrothermal transducer elements provided on the printing head 1, a main scanning motor driving circuit 124 configured to drive the main scanning motor 104, an LF motor driving circuit 125 configured to drive the IF motor 116, and the like are connected to the CPU 120. Moreover, the motor 14 serving as a driving source for opening and closing the above-described air valve 9, for moving the diaphragm portion 3, and so forth is connected to the CPU 120. Furthermore, a display unit 52 for displaying an operating state of the inkjet printing apparatus, the ASF 114 for supplying the printing medium, and the like are connected to the CPU 120. In addition, the above-described air valve sensor 43, the diaphragm portion sensor 42, the paper end sensor 112, and the like are connected to the CPU 120. Meanwhile, a liquid detection circuit 50 configured to output a signal indicating as to whether or not the ink contained in any of the main tank 5 and the sub tank 4 is a predetermined amount or less is connected to the CPU 120. This liquid detection circuit 50 applies predetermined voltages respectively between the first hollow pipe 11 and the second hollow pipe 12 described above, and between the first hollow pipe 11 and the solid rod 13. Then, the liquid detection circuit 50 detects whether or not a current flows between the first hollow pipe 11 and the second hollow pipe 12, or between the first hollow pipe 11 and the solid rod 13. When the current flow is detected, the liquid detection circuit 50 outputs a detection signal to the CPU 120. Note that this liquid detection circuit 50, the hollow pipes 11 and 12, and the solid rod 13 collectively constitute liquid detecting means for detecting whether or not there is the ink left inside the main tank or the sub tank.

Meanwhile, in the above-described control system, the CPU 120 controls various operations including the printing operation, an operation to fill the sub tank with ink, and the like in accordance with the control programs stored in the ROM 121 in response to the signals outputted from the liquid detection circuit 50 and from the sensors. For example, in the operation to fill the sub tank with ink which is executed after replacing the main tank 5, the signals indicating the phases of the respective cams 25 and 20 detected by the diaphragm portion sensor 42 and the air valve sensor 43 are inputted to the CPU 120. Based on these phases and the signals from the liquid detection circuit 50, the CPU 120 controls a direction of rotation and an amount of rotation of the motor 14.

In the inkjet printing apparatus 100 configured as described above, a negative pressure is generated inside the printing head 1 when the printing head 1 ejects the ink and the ink is thereby consumed. The negative pressure inside the printing head 1 is transmitted to the sub tank 4 through the tube 2, and the ink inside the sub tank 4 is supplied to the printing head 1. In this case, since the air communication valve 9 is closed, the negative pressure propagates inside the sub tank 4 without escaping to the outside. Then, since the main tank 5 is communicated with the sub tank 4 through the first hollow pipe 11 as described above, the ink is supplied from the main tank 5 to the sub tank 4 when the negative pressure is generated inside the sub tank 4. Meanwhile, in this embodiment, since the main tank 5 is communicated with the buffer chamber 6 through the second hollow pipe 12 as described above, the air inside the buffer chamber 6 that is communicated with the outside through the air communication path 7 can flow into the main tank 5. Therefore, even if the ink inside the main tank 5 is reduced by performing the printing operation as described above, it is possible to achieve a balance between the pressure inside the main tank 5 and the atmosphere and thereby to suppress excessive reduction in the pressure inside the main tank 5.

In this embodiment, the main tank 5 is communicated with the sub tank 4 through the first hollow pipe 11 having the sufficiently large flow resistance so as not to allow the ink to be communicated only by the gravity. Since the flow resistance inside the first hollow pipe 11 is sufficiently large, only the amount of the ink equivalent to that consumed in the printing head 1 is supplied from the inside of the main tank 5 to the sub tank 4. Accordingly, only the appropriate amount of the ink required by the sub tank 4 is supplied from the main tank 5, and the supply of the excessive ink from the main tank 5 into the sub tank 4 due to the gravity is suppressed. For this reason, the liquid level of the ink inside the sub tank 4 is regulated to be located within a predetermined range. In this embodiment, when the ink is contained in the main tank 5, the liquid level of the ink inside the sub tank 4 is regulated to be located between the lower end portion of the solid rod 13 and the upper surface of the sub tank 4.

When the printing operation is continued in the printing apparatus of this embodiment and the ink inside the main tank 5 is continuously consumed, the ink inside the main tank 5 is eventually exhausted. When the ink inside the main tank 5 is exhausted and the tank becomes empty, the air will be supplied from the main tank 5 to the sub tank 4. Therefore, when the ink is continuously ejected from the printing head 1 after the main tank 5 is empty, the air is supplied into a supply path 10 of the sub tank 4. This air flows into the supply path 10 in the sub tank 4 through the first hollow pipe 11 connecting the main tank 5 and the sub tank 4. As described above, when the printing head 1 consumes the ink after the ink inside the main tank 5 is exhausted and the tank becomes empty, the ink inside the sub tank 4 is replaced by the air inside the main tank 5 whereby the air flows into the sub tank 4.

In this embodiment, the predetermined voltage is applied between the hollow pipe 11 and the solid rod 13 functioning as an ink sensor to judge presence of the ink inside the supply path 10 depending on whether or not electricity is conducted between the hollow pipe 11 and the solid rod 13. In this case, the electricity is conducted between the hollow pipe 11 and the solid rod 13 when the ink is present inside the supply path 10, and the electricity is not conducted if there is a region where the ink is absent. A judgment as to whether or not the ink is contained in the supply path 10 is made depending on the presence or absence of the conductivity, whereby the presence or absence of the ink inside the main tank 5 is detected. For example, if the electrical connection between the hollow pipe 11 and the solid rod 13 is cut off, it is then detected that consumption of the ink inside the sub tank 4 is initiated. In this case, it is conceivable that there is no ink left inside the main tank 5 and the air inside the main tank 5 is therefore drawn into the supply path 10 of the sub tank 4. In order to improve precision of detection of the presence or absence of the ink inside the main tank 5, a small cylinder portion having a relatively small inside diameter is formed to protrude vertically. In this embodiment, the hollow pipe 11 has an inside diameter of 1.6 mm and the supply path 10 has an inside diameter from 2 to 3 mm. When the main tank 5 becomes almost empty, the air is introduced into the hollow pipe 11 and the supply path 10. Hence the electrical connection is cut off and an ink shortage is detected. Moreover, in this case, the wall surface that constitutes the supply path 10 is formed into a cylindrical shape having a relatively small inside diameter. Accordingly, the change of the liquid level becomes relatively large when the air is supplied into the sub tank 4 and the liquid level of the ink is reduced. As described above, since the liquid level of the ink is largely changed when the air is supplied into the sub tank 9, it is possible to cut off the conduction between the hollow pipe 11 and the solid rod 13 reliably even when the amount of the air that flows from the main tank into the sub tank is small. In this way, it is possible to detect the condition that the ink inside the main tank 5 is exhausted from the change of the liquid level of the ink. As described above, an ink presence/absence detection sensor (a liquid presence/absence detection sensor) configured to detect the presence or absence of the ink at a position close to an ink supply port from the main tank 5 and to detect that the supply of the ink from the main tank 5 is stopped is provided inside the sub tank 4. Particularly, in this embodiment, the hollow pipe 11 has the function as the ink supply port from the main tank 5 and the ink presence/absence detection sensor at the same time, and the position of the ink supply port from the main tank 5 is substantially the same as the position to detect the presence or absence of the ink.

When replacing the main tank 5, a certain amount of the ink is kept inside the sub tank 4. After the ink shortage of the main tank 5 is detected by detecting the presence or absence of the ink inside the supply path 10 of the sub tank 4, an amount of ink consumption by the printing head 1 is calculated based on a number of times of ink ejection, and then a residual amount of the ink inside the sub tank 4 is calculated based on the amount of ink consumption. Thereafter, the printing operation will be eventually stopped if the printing operation is continued without replacing the main tank 5 and the sub tank 4 thereby becomes empty. In this case, the printing operation is forced to be stopped and a notifying operation takes place in order to urge the replacing operation of the main tank 5.

When the ink shortage inside the main tank 5 is detected, the printing apparatus notifies a user of the ink shortage by displaying a notice on a display or the display unit of the printing apparatus.

When replacing the main tank 5, the main tank 5 is pulled upward and the first hollow pipe 11 and the second hollow pipe 12 are pulled out of the main tank 5. Then, the new main tank 5 is attached so that the first hollow pipe 11 and the second hollow pipe 12 penetrate the wall surface of the main tank 5. Hence the sub tank 4 and the buffer chamber 6 are connected to the main tank 5.

In this embodiment, a predetermined voltage is applied between the first hollow pipe 11 and the second hollow pipe 12 so that it is possible to confirm attachment of the main tank 5 filled with the ink depending on whether or not the electricity is conducted between the first hollow pipe 11 and the second hollow pipe 12. As described above, in this embodiment, there is provided a main tank attachment detection sensor (a first ink tank attachment detection sensor) configured to detect attachment of the main tank 5 filled with the ink.

Figure 4:
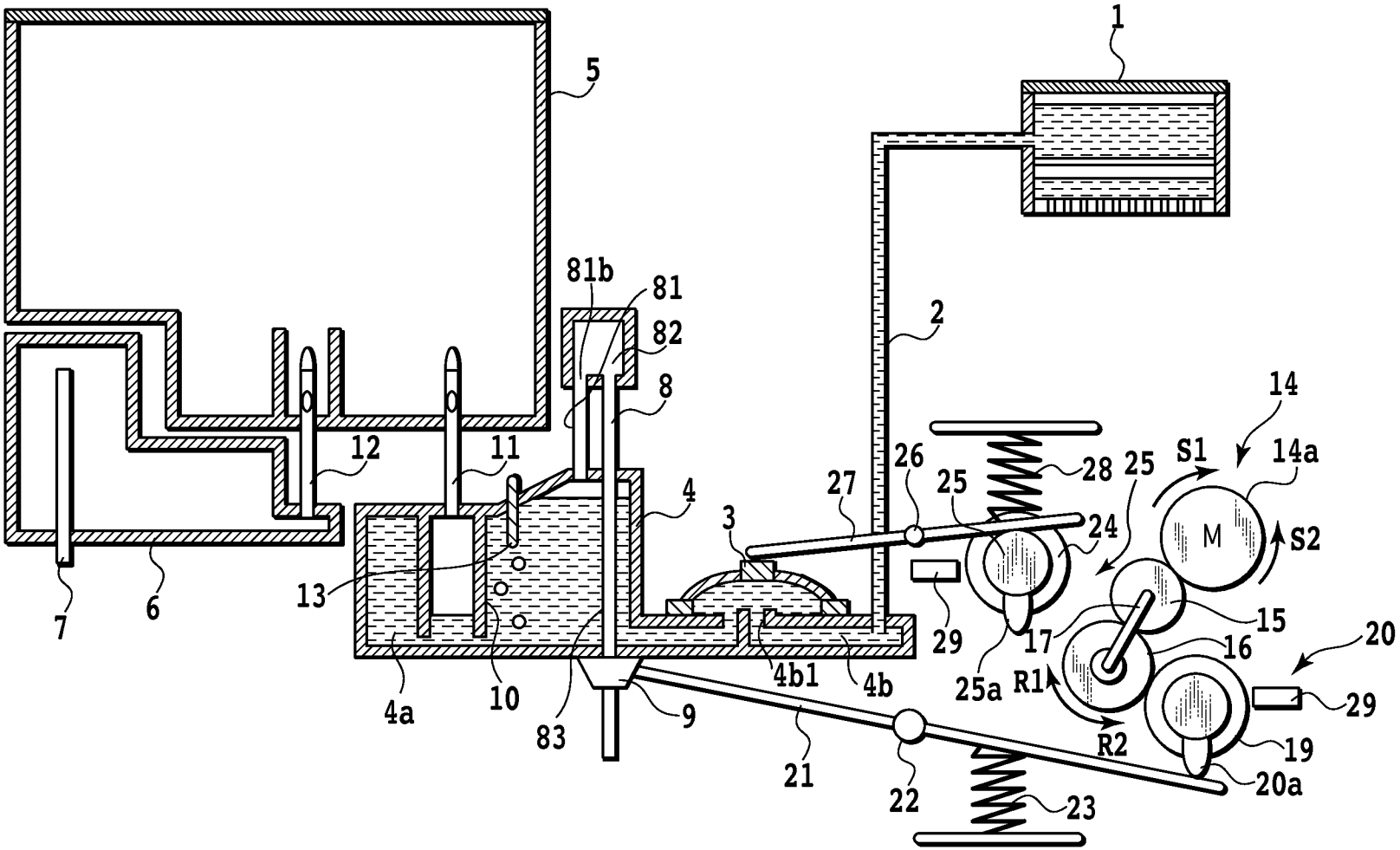
FIG. 4 is a schematic cross-sectional view showing a state where an ink inside a main tank is exhausted and air is supplied to a sub tank.
Figure 5:
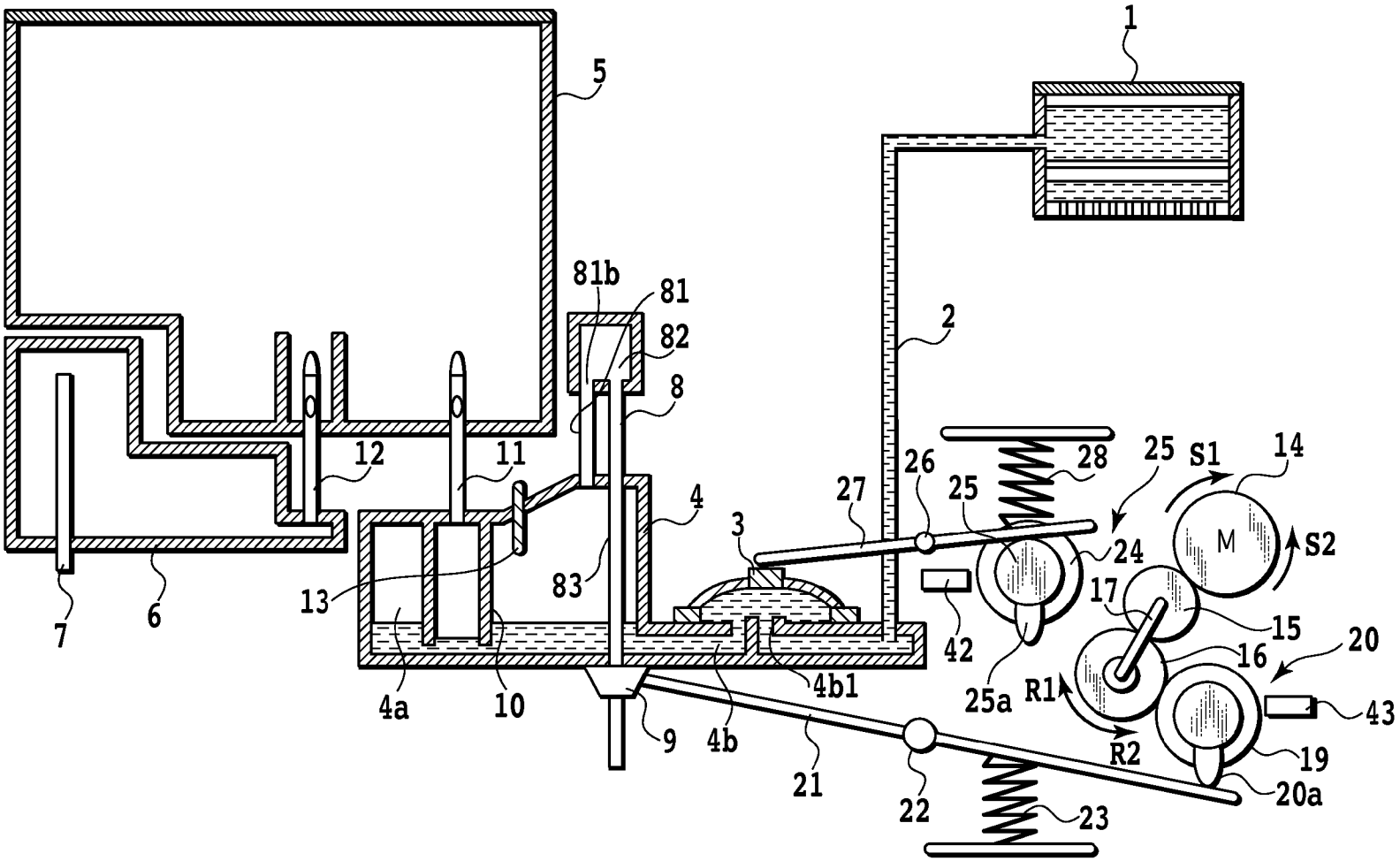
FIG. 5 is a schematic cross-sectional view showing a state where the ink inside the main tank is exhausted and the ink inside the sub tank is consumed and decreased.

FIG. 5 is an explanatory view showing a state where the ink inside the sub tank 4 is further consumed and reduced as a result of continuously performing the printing operation after the state shown in FIG. 4. When the printing operation is in progress, the air communication valve 9 is closed and the diaphragm portion 3 is set to the initial state of being expanded outward. Accordingly, the internal volume of the diaphragm portion 3 is maintained at the expanded state.

Figure 6:
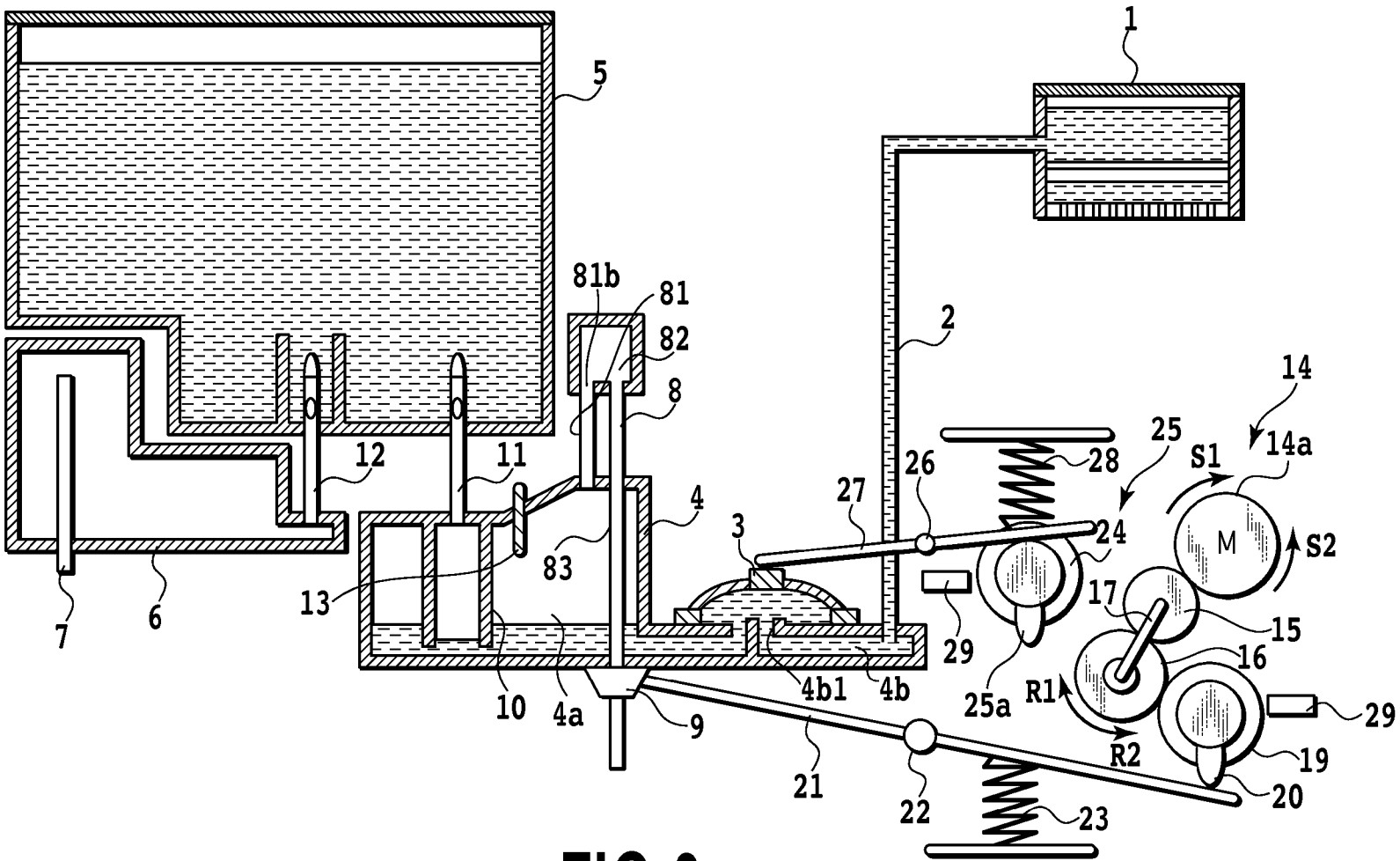
FIG. 6 is a schematic cross-sectional view showing a state where a new main tank is installed.

Although the main tank 5 is disposed in the higher position than the sub tank 4, the ink is not supplied into the sub tank 4 immediately after mounting the main tank 5 filled with the ink. Usually, the main tank 5 is replaced when the tank is empty. Therefore, before replacing the main tank 5, the air is drawn from the empty main tank 5 into the supply path 10 in the sub tank 4, and the air flows into the sub tank 4 as shown in FIG. 6. Accordingly, when the main tank 5 is replaced, the air usually remains inside the supply path 10 of the sub tank 4.

Meanwhile, the air communication valve 9 is closed when replacing the main tank 5. Moreover, the air is held above the ink inside the sub tank 4. Accordingly, even when the main tank 5 filled with the ink is communicated with the sub tank 4 after replacing the main tank 5, the air held above is not discharged to the outside of the sub tank 4. Hence the ink hardly flows into the sub tank 4. For this reason, even when the main tank 5 is replaced, the ink is not supplied from the main tank 5 unless the negative pressure is generated inside the sub tank 4.

Figure 7A:
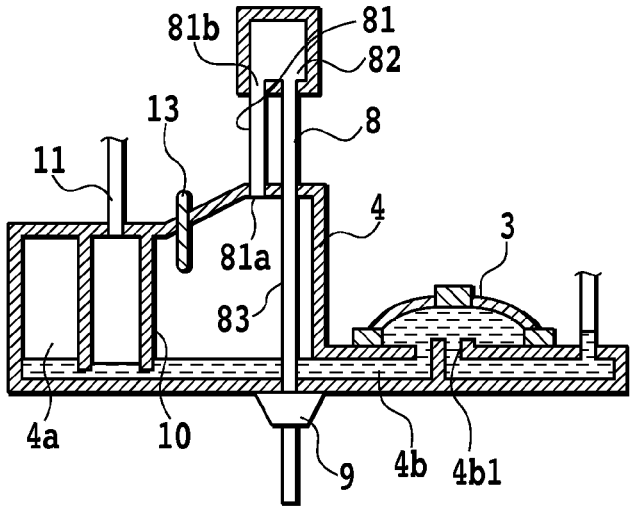
FIGS. 7A to 7C are schematic enlarged cross-sectional views of the sub tank in the ink supply system of FIG. 2, showing states where the diaphragm portion is expanded and contracted and thereby an air communication port is opened and closed.
Figure 7B:
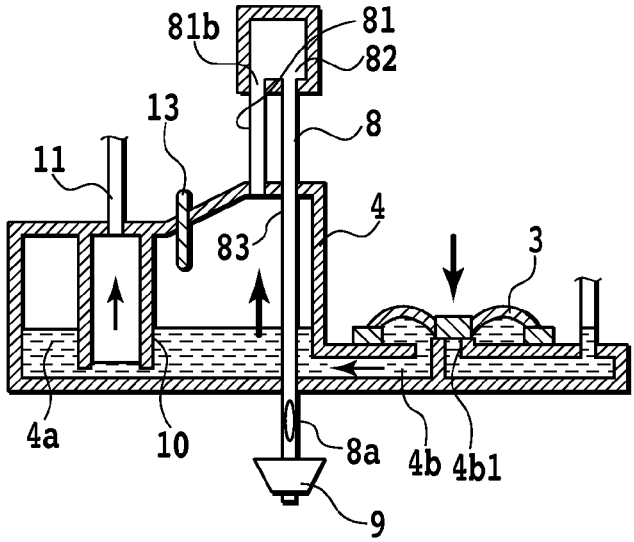
Figure 7C:
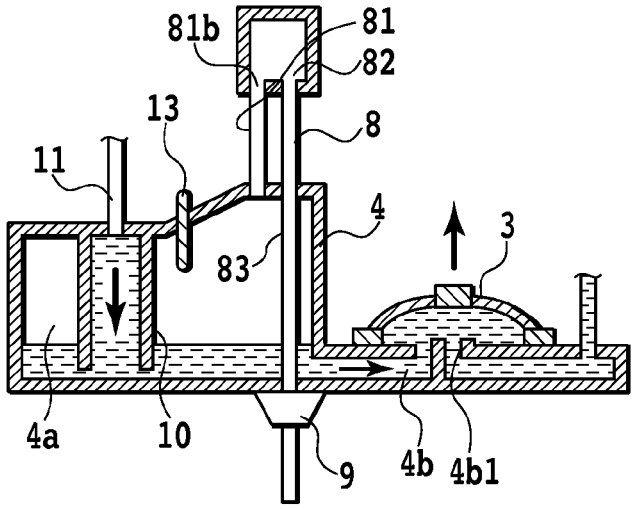
Figure 8:
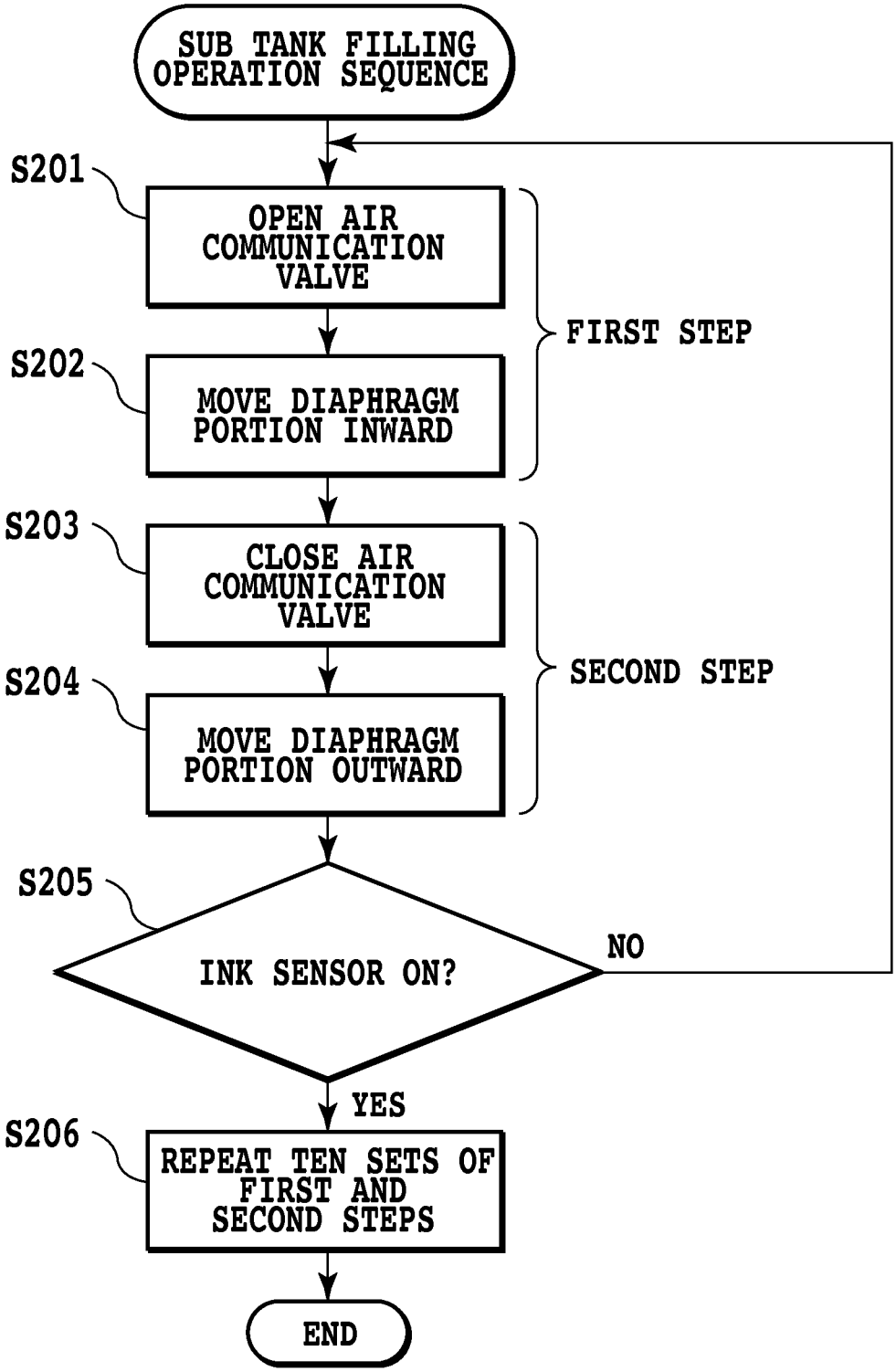
FIG. 8 is a flowchart showing steps for filling the ink.

Therefore, in order to supply the ink to the sub tank 4, it is necessary to generate the negative pressure inside the sub tank 4, to replace the air inside the sub tank 4 with the ink inside the newly replaced main tank 5, and to fill the ink into the sub tank 4. Here, an outline of the operation to fill the sub tank with the ink will be described with reference to FIG. 7A to FIG. 8. FIGS. 7A to 7C are explanatory views showing operations of the respective constituents around the sub tank when filling the sub tank with the ink, while FIG. 8 is a flowchart showing a control process in the operation to fill the sub tank with the ink shown in FIGS. 7A to 7C.

FIG. 7A shows a state where the main tank 5 is replaced and there is little ink left inside the sub tank. FIG. 7B shows a state where the air in the sub tank 4 is sent out of the sub tank 4 by moving the diaphragm portion 3 inward. FIG. 7C shows a state where the ink is being supplied from the main tank 5 into the sub tank 4 by moving the diaphragm portion 3 outward.

As shown in FIG. 7A, immediately after the main tank 5 is replaced, the diaphragm portion 3 bulges out and the internal volume thereof is expanded. At this time, the air communication valve 9 is closed. Next, as shown in FIG. 7B, the air communication valve 9 is switched from the closed state to the open state (S201), and then the diaphragm portion 3 is moved inward to contract the internal volume thereof (S202). The volume changes by about 0.5 cc due to the movement of the diaphragm portion 3.

By moving the diaphragm portion 3 inward, the ink equivalent to about 0.5 cc is pushed out of the diaphragm portion 3 toward a portion of the sub tank 4 located closer to the main tank. At this time, a flow resistance $\Delta P_H$ (a flow resistance of the supply tube 2) from the diaphragm portion 3 to the printing head 1 is far higher than a flow resistance $\Delta P_S$ from the diaphragm portion 3 to the sub tank 4 (the main tank 5). Therefore, the ink is hardly pushed out to the printing head 1.

The flow resistance inside the pipe can be expressed as the following formula in terms of a pressure loss of the flow inside the pipe.

The pressure loss ΔP can be expressed as:

$$\Delta P = Q \times (128\ \mu \Delta L)/\pi d^4 \quad (1).$$

Here, Q denotes an ink flow rate, μ denotes ink viscosity, ΔL denotes a flow path length, and d denotes an inside diameter of the flow path.

In this embodiment, the supply tube 2 has an inside diameter of 2.4 mm and a length of about 1.9 m. Meanwhile, a section of the flow path portion 4*b* from the diaphragm portion 3 to the liquid chamber portion 4*a* has an inside diameter of about 5 mm and a length of about 10 mm. In this case, a ratio between the flow resistance $\Delta P_H$ from the diaphragm portion 3 to the printing head 1 and the flow resistance $\Delta P_S$ from the diaphragm portion 3 to the flow path portion 4*b* is as follows:

$$\Delta P_H : \Delta P_S = 3580:1 \quad (2).$$

Therefore, the flow resistance from the diaphragm portion 3 to the printing head 1 is by far larger than the flow resistance from the diaphragm portion 3 to the flow path portion 4*b* in the sub tank 4.

Accordingly, even when the ink inside the sub tank 4 is compressed by moving the diaphragm portion 3, the ink contained in the sub tank 4 is hardly pushed out to the printing head 1. As a result, the ink which is compressed and pushed out of the diaphragm, portion 3 by moving the diaphragm, portion 3 inward is directed to the sub tank 4.

Next, a resistance value $\Delta P_{H2}$ of the ink when the ink is assumed to flow into the main tank 5 through the supply path 10 in the sub tank and through the first hollow pipe 11 will be compared with a resistance value $\Delta P_A$ of the air when the air inside the sub tank 4 is discharged to the atmosphere through the air communication path 8 in the sub tank 4. In this embodiment, the viscosity of the ink is about 100 times as high as the viscosity of the air. Moreover, the supply path 10 has an inside diameter of about 2 to 3 mm and a length of about 20 mm, and the first hollow pipe 11 has an inside diameter of 1.6 mm and a length of about 30 mm. Meanwhile, the air communication path 8 has an inside diameter of 2.7 mm and a length of about 74 mm. Therefore, the ratio between the flow resistance $\Delta P_{H2}$ from the sub tank 4 to the main tank 5 and the flow resistance $\Delta P_A$ from the sub tank 4 to the atmosphere through the air communication path 8 is as follows:

$$\Delta P_{H2} : \Delta P_A = 27.5:1 \quad (3).$$

As described above, the flow resistance $\Delta P_A$ from the sub tank 4 to the atmosphere when the air communication valve 9 is opened is far smaller than the flow resistance $\Delta P_{H2}$ from the sub tank 4 to the main tank 5. For this reason, when the diaphragm portion 3 is moved inward to reduce the internal volume thereof and the ink and the air inside the sub tank 4 are compressed, the air inside the sub tank 4 passes through the air communication valve 9 and is discharged to the atmosphere. Therefore, the pressure inside the sub tank 4 is not increased and the ink hardly flows into the main tank 5.

Next, as shown in FIG. 7C, the air communication valve 9 is switched from the open state to the closed state (S203), and then the diaphragm portion 3 is switched from the state of being pressed inward to the initial state of bulging outward (S204). The internal volume of the diaphragm portion 3 is increased by this movement. In this way, the negative pressure is generated inside the sub tank 4 whereby the ink in the amount of about 0.5 cc flows into the diaphragm portion 3, and the ink is supplied from the main tank 5 to the sub tank 4. At this time, the flow resistance from the diaphragm portion 3 to the printing head 1 is relatively higher than the flow resistance from the diaphragm portion 3 to the main tank 5. Accordingly, the ink closer to the printing head 1 hardly flows into the diaphragm portion 3. In this embodiment, the supply path 10 has the inside diameter of about 2 to 3 mm and the length of about 20 mm, and the first hollow pipe 11 has the inside diameter of 1.6 mm and the length of about 30 mm. Therefore, the ratio between the flow resistance $\Delta P_H$, from the diaphragm portion 3 to the printing head 1 and a flow resistance $\Delta P_T$ from the diaphragm portion 3 to the main tank 5 is as follows:

$$\Delta P_H : \Delta P_T = 11:1 \quad (4).$$

Hence the flow resistance from the diaphragm portion 3 to the printing head 1 is substantially larger. Therefore, the ink closer to the printing head 1 hardly flows into the diaphragm portion 3. In this case, the air hardly enters from the outside of the printing apparatus into the sub tank 4 through the air communication path 8 because the air communication valve 9 is closed. Moreover, although a negative pressure is generated inside the main tank 5, the negative pressure inside the main tank 5 disappears as the air taken in through the air communication path 7 is introduced from the buffer chamber 6 into the main tank 5. As a result, a certain amount of the ink is introduced from the main tank 5 to the sub tank 4.

Next, there will be described operations of the constituents of the driving mechanism 30 in the case of supplying the ink from the main tank 5 into the sub tank 4 after replacing the main tank 5 in the ink supply system of this embodiment.

As described previously, in order to supply the ink from the main tank 5 to the sub tank 4 while removing the air from the inside of the sub tank 4 after replacement of the main tank 5, the expanding and contracting operations of the diaphragm portion 3 (the movement of the diaphragm) and the opening and closing operations of the air communication valve 9 are repeated. Generally, two states are conceivable as the status of the diaphragm portion 3 and the air communication valve 9 in the printing apparatus in this case. One of the states is a states shown in FIG. 2 where the diaphragm portion 3 bulges outward of the sub tank 4 and the internal volume of the diaphragm portion 3 is expanded (this state will be hereinafter referred to as an expanded state of the diaphragm portion) while the air communication valve 9 is closed. Meanwhile, the other state is a state shown in FIG. 3, where the diaphragm portion 3 is pressed and the internal volume of the diaphragm portion 3 is contracted (this state will be hereinafter referred to as a contracted state of the diaphragm portion) while the air communication valve 9 is opened.

The operations of the constituents will be described below when switching from the state shown in FIG. 2 where the diaphragm portion 3 is in the expanded state and the air communication valve 9 is closed to the state shown in FIG. 3 where the diaphragm portion is in the contracted state and the air communication valve 9 is opened.

In the state shown in FIG. 2, the pressing portion 20*a* of the first cam 20 presses the end portion (a right end portion in the drawing) of the air valve lever 21 against the biasing force of the compression spring 23. Accordingly, the air communication valve 9 provided on the other end portion (a left end portion in the drawing) of the air valve lever 21 closes the air communication port 8*a*. Meanwhile, the pressing portion 25*a* of the second cam 25 is located away from the diaphragm lever 27, and the diaphragm lever 27 abuts on a circular outer peripheral surface of the cam 25 by the biasing force of the spring 28. In this case, one end portion (a left end portion in the drawing) of the diaphragm lever 27 is in the state of not pressing the diaphragm portion 3 (the open state) and the diaphragm portion 3 is maintained in the expanded state.

Here, the motor 14 is firstly driven to rotate the driving gear 14*a* in the direction S2. A rotating force of this driving gear 14*a* is transmitted to the planetary gear 16 via the idle gear 15, and the planetary gear 16 is rotated about the rotation center thereof. Meanwhile, the idle gear 15 is rotated at a fixed position about an unillustrated axis which is fixed to a certain position. By the rotation of the planetary gear 16, the first cam 20 is rotated together with the gear 19 that is engaged with the planetary gear 16, and the pressing portion 20*a* thereon is moved away from the end portion (the right end portion) of the air valve lever 21. As a result, the air valve lever 21 is rotated counterclockwise in FIG. 2 about the fulcrum 22 by the biasing force of the compression spring 23, thereby moving the air communication valve 9 away from the position to close the air communication port 8*a*. In this way, the air communication port 8*a* is opened to the atmosphere.

Next, when the driving gear 14*a* is rotated in the direction S2 by use of the motor 14, the idle gear 15 engaged with the driving gear is rotated. By the rotation of the idle gear 15, the planetary gear 16 engaged with the idle gear 15 moves in the direction R1 and is engaged with the gear 24 as shown in FIG. 3. Thereafter, the gear 16 is rotated about the rotation center thereof by continuously driving the motor 14. Accordingly, the pressing portion 25*a* moves to a position opposed to the diaphragm lever 27 and presses the end portion (the right end in the drawing) of the diaphragm lever 27 against the biasing force of the compression spring 28. In this way, the other end portion (the left end portion in the drawing) of the diaphragm lever 27 presses the diaphragm portion 3 to achieve the contracted state of the diaphragm portion 3 (see FIG. 3). By contracting the diaphragm portion 3 as described above, the ink inside the diaphragm portion 3 is send to the liquid chamber 4*a* side of the sub tank 4 whereby the liquid level of the ink inside the liquid chamber 4*a* rises. At this time, the air communication port 8*a* is set to the open state by the air communication valve 9. Accordingly, the air stored in the upper portion of the sub tank 4 is discharged to the outside through the air communication port 8*a* as the liquid level of the ink inside the liquid chamber 4*a* rises.

As described above, it is possible to change the positional relationship of the diaphragm portion 3 and the air communication valve 9 from the state shown in FIG. 2 to the state shown in FIG. 3.

Next, operations of the respective constituents will be described below when switching from the state shown in FIG. 3 where the diaphragm portion 3 is in the contracted state and the air communication valve 9 is opened to the state shown in FIG. 2 where the diaphragm portion 3 is in the expanded state and the air communication valve 9 is closed.

When the driving gear 14*a* is rotated in the direction S1 by driving the motor 14 from the contracted state of the diaphragm shown in FIG. 3, the planetary gear 16 moves in the direction R2 along with the rotation of the idle gear 15 and is engaged with the gear 19. Thereafter, by driving the motor 14 continuously, the planetary gear 16 is rotated via the idle gear 15, and the gear 19 and the cam 20 are rotated in conjunction with the rotation. By the rotation of the cam 20, the pressing portion 20*a* presses the end portion of the air valve lever 21 against the biasing force of the compression spring 23, and the air valve lever 21 rotates about its fulcrum. The air communication valve 9 moves along with the movement of the air valve lever 21 and closes the air communication port 8*a* previously maintained at the open state. At this point, the motor 14 temporarily stops the rotation. Meanwhile, the diaphragm portion 3 maintains the contracted state as shown in FIG. 3.

After the air communication port 8*a* is closed by the air communication valve 9 as described above, the driving gear 14*a* is rotated in the direction S2 by driving the motor 14. As the idle gear 15 is rotated in conjunction with the rotation of the driving gear 14*a*, the planetary gear 16 moves in the direction R1 and is engaged with the gear 24. As the driving gear 14*a* is continuously rotated by the driving force of the motor 14 even after the planetary gear 16 is engaged with the gear 24, the planetary gear 16 is rotated about the rotation center thereof and thereby rotates the gear 24. In this way, the pressing portion 25*a* of the cam 25 is moved away from the diaphragm lever 27 whereby the diaphragm lever 27 is rotated clockwise in FIG. 3 about the fulcrum 26 by the biasing force of the compression spring 28. As a result, the diaphragm lever 27 stops applying the pressing force to the diaphragm portion 3 and the diaphragm portion 3 recovers the expanded state shown in FIG. 2 by resilience thereof. At this time, since the air communication port 8*a* is closed, the negative pressure is generated inside the sub tank 4 due to the recovery of the diaphragm portion 3 in the expanded state. As a result, the ink inside the main tank 5 flows into the sub tank 4 through the hollow pipe 11.

As described above, by repeating the contracting and expanding operations of the diaphragm 3 and the opening and closing operations of the air communication port 8*a*, the certain amount of the ink (which is 0.5 cc in this embodiment) in the main tank 5 is supplied to the sub tank 4 for every cycle of operations. When the gears 19 and 24 are rotated in the above-described operations, the phases of the cams 20 and 25 are accurately detected by the air valve sensor 43 and the diaphragm portion sensor 42 which are attached so as to correspond to the respective gears 19 and 24. Therefore, the open state or the close state of the air communication valve 9 and the expanded state or the contracted state of the diaphragm portion 3 are grasped accurately.

Figure 10A:
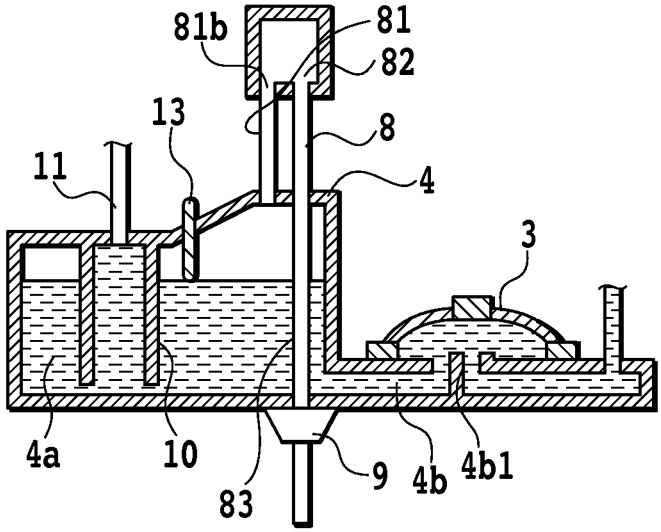
FIG. 10A is a schematic cross-sectional view showing a state where a liquid level of the ink touches a solid rod inside the sub tank.
Figure 10B:
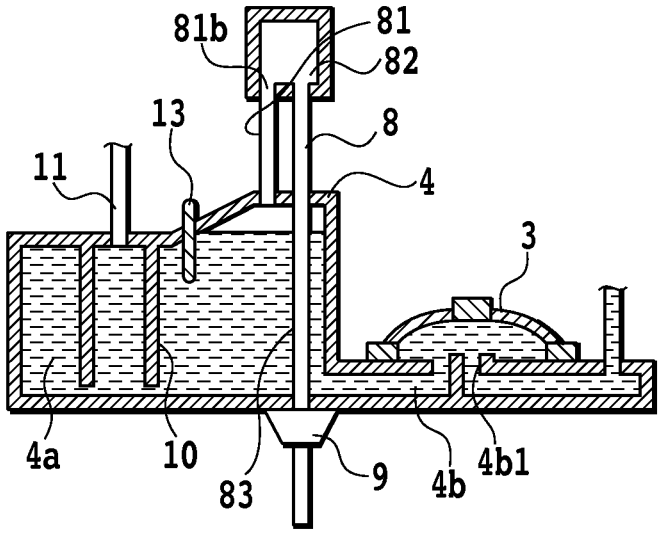
FIG. 10B is a schematic cross-sectional view showing a state where an operation to fill the sub tank with the ink is completed.

FIG. 10A shows the printing apparatus in a state where the liquid level of the ink touches the solid rod 13 in the sub tank 4, and FIG. 10B shows the printing apparatus in a state where the operation to fill the sub tank 4 with the ink is completed.

As described previously, the method of detecting the presence or absence of the ink inside the main tank 5 applies the judgment as to whether or not the space between the solid rod 13 in the sub tank 4 and the hollow pipe 11 in the main tank 5 is filled with the ink. Here, if the space between the solid rod 13 and the hollow pipe 11 is filled with the ink, the electricity is conducted when the current is applied therebetween. Such conductivity is detected by sensing an electric signal from one end at the other end. Thus, it is possible to detect the condition that the space is filled with the ink. In the operation to fill the sub tank 4 with the ink, similar judgment is made, in which whether or not the space between the solid rod 13 and the hollow pipe 11 is electrically conductive is judged. FIG. 10A shows a state immediately after the electricity is conducted as the space is filled with the ink (S205). In this embodiment, a ceiling surface of the sub tank 4 is inclined. The discharge port to the atmosphere is located at a position higher than the inclined surface. Meanwhile, the ink introduction port from the main tank 5 to the sub tank 4 is located at a position lower than the inclined surface. The solid rod 13 for detecting the presence or absence of the ink is located in the middle of the inclined surface. By using this configuration, the air remaining inside the sub tank 4 is smoothly removed through the air communication path 8. By forming the sub tank 4 as described above, it is possible to avoid erroneous detection at the time of detecting the presence or absence of the ink, which is caused by the air that stays inside the sub tank 4 even after filling the ink therein and obstructs detection of the presence of the ink. In the state shown in FIG. 10A, a certain amount of the ink has been filled in the sub tank 4. In this embodiment, a set of control including a first step and a second step is repeatedly performed ten times before completion (S206). Note that the number of times to repeat the first step and the second step is not limited only to ten times and these steps may be repeated in a different number of times instead. It is also possible to repeat the first step and the second step until the presence of the ink is detected in the space between the solid rod 13 and the hollow pipe 11 in the process of detecting the ink presence. Alternatively, it is also possible to adjust the amount of the ink inside the sub tank depending on printing applications.

Note that a certain number of times of each of the expanding and contracting operations of the diaphragm portion and the opening and closing operations of the air communication valve 9 are carried out after detecting the residual amount. Specifically, the opening and closing operations are repeated ten times in this embodiment. However, it is also possible to terminate the opening and closing operations when the residual amount detection confirms that a sufficient amount of ink is filled in the supply path 10 of the sub tank 4.

Moreover, in this embodiment, the ratio between the flow resistance $\Delta P_I$, from the diaphragm portion 3 to the printing head 1 and the flow resistance $\Delta P_T$ from the diaphragm portion 3 to the main tank 5 is defined as:

$$\Delta P_H:\Delta P_T=11:1 \quad (5).$$

However, the supply tube used in the present invention is not limited only to this configuration. It is also possible to apply other tubes having different lengths and inside diameters. When a different embodiment applies a printing apparatus having the same configuration as the above-described embodiment except a supply tube having an inside diameter of 2.4 mm and a length of about 1 m, the ratio will be defined as $\Delta P_H:\Delta P_T=6:1$. Here, $\Delta P_H$ denotes the flow resistance from the diaphragm portion 3 to the printing head 1 and $\Delta P_T$ denotes the flow resistance from the diaphragm portion 3 to the main tank 5. The same sub tank 4 as the one use in the above-described embodiment is used in the different embodiment, and the supply path 10 has the inside diameter of about 2 to 3 mm and the length of about 20 mm while the first hollow pipe 11 has the inner diameter of 1.6 mm and the length of about 30 mm. The different embodiment achieves substantially similar effects to the embodiment described above.

The present invention is not limited only to the embodiment described above. As long as the magnitude relations between the flow resistances are maintained, substantially similar effects are achieved by controlling other behaviors (such as opening and closing speed of the diaphragm portion).

As described above, in this embodiment, the ink is filled into the sub tank by repeating the step of contracting the internal volume of the diaphragm portion 3 after opening the air communication port 8*a* and the step of expanding the internal volume of the diaphragm portion 3 after closing the air communication port 8*a*. Therefore, the structure for generating the negative pressure inside the sub tank 4 to supply the ink from the main tank 5 to the sub tank 4 can be made simple. In this way, it is possible to simplify the structure of the printing apparatus and to reduce manufacturing costs of the printing apparatus.

Moreover, according to the configuration of the printing apparatus of this embodiment, it is possible to use the single driving source to drive the means for generating the negative pressure to supply the ink into the sub tank 4 and to drive the driving mechanism for removing the air from the inside of the sub tank 4. In general, the driving source for generating the negative pressure inside the sub tank 4 and the driving source for removing the air from the sub tank 4 are separately provided. Accordingly, a conventional printing apparatus requires separate driving sources such as motors and therefore causes an increase in the manufacturing costs of the printing apparatus. On the other hand, in this embodiment, by selectively performing the operation to change in the volume of the diaphragm portion 3 and the operation to open and close the air communication valve 9, the single driving source functions as the driving source for generating the negative pressure in the sub tank 4 and as the driving source for removing the air from the sub tank 4. Therefore, it is possible to further simplify the structure of the printing apparatus and thereby to further reduce the manufacturing costs of the printing apparatus.

Here, the method of filling the sub tank with a liquid according to this embodiment includes a variable volume member contracting step (S202) of contracting the internal volume of the diaphragm portion 3 after opening the air communication port 8*a*. Moreover, the method of filling the sub tank with a liquid according to this embodiment includes a variable volume member expanding step (S201) of expanding the internal volume of the diaphragm portion 3 after closing the air communication port 8*a*. At this time, in order to supply the ink to the sub tank 4 quickly, a period from opening the air communication port 8*a* to contracting the internal volume of the diaphragm portion 3 is preferably set as short as possible in the variable volume member contracting step of contracting the internal volume of the diaphragm portion 3. In this embodiment, the period from opening the air communication port 8*a* to contracting the internal volume of the diaphragm portion 3 is set no longer than 5 seconds. Similarly, a period from closing the air communication port 8*a* to expanding the internal volume of the diaphragm portion 3 is preferably set as short as possible in the variable volume member expanding step of expanding the internal volume of the diaphragm portion 3 after closing the air communication port 8*a*. In this embodiment, the period from closing the air communication port 8*a* to expanding the internal volume of the diaphragm portion 3 is set no longer than 5 seconds.

Moreover, it is also preferable to set an interval between the variable volume member contracting step of contracting the internal volume of the diaphragm portion 3 after opening the air communication port 8*a* and the variable volume member expanding step of expanding the internal volume of the diaphragm portion 3 after closing the air communication port 8*a* as short as possible. In this embodiment, when the variable volume member contracting step and the variable volume member expanding step are repeated for supplying the ink to the sub tank 4, the interval between the two consecutive steps is set no longer than 5 seconds.

In this embodiment, the movements of the diaphragm portion 3 and the opening and closing operations of the air communication valve 9 are performed by biasing the diaphragm lever 27 and the air valve lever 21 with the springs and by changing the direction of rotation of the motor 14 to switch the gear to be engaged with the planetary gear 16. However, the present invention is not limited only to the configuration of this embodiment, and it is also possible to perform the expanding and contracting operations of the diaphragm portion and the opening and closing operations of the air communication valve 9 by using other methods. For example, it is also possible to provide two motors for driving the respective gears 19 and 24 separately thereby driving the gears 19 and 24 independently by using the respective motors.

(Characteristic Configuration)

According to the basic configuration described above, a coloring material component (such as a pigment component) causes sedimentation when a printing operation does not take place for a certain period of time, i.e., when the ink does not flow inside the ink supply path for a certain period of time. This causes a difference in density distribution of the coloring material component in the vertical direction of the tank. Specifically, a layer having a high coloring material density is formed at a lower part while a layer having a low coloring material density is formed at a higher part. If the printing operation is started with such a difference in the density distribution, the ink will be initially supplied from the lower layer having the high coloring material density. Hence image quality may be significantly deteriorated as a result of outputting an excessively high-density image.

The variation in the coloring material density of the ejected ink not only causes the problem of generating the density difference on the outputted image as described above. In case of a color inkjet printing system configured to use multiple color inks and to express desired color phases based on predetermined color balances, the variation in the coloring material density leads to destruction of such color balances. Accordingly, there occurs a problem that image deterioration due to unevenness of color is recognized.

A characteristic configuration to be employed to avoid such inconvenience will be described below.

Figure 11:
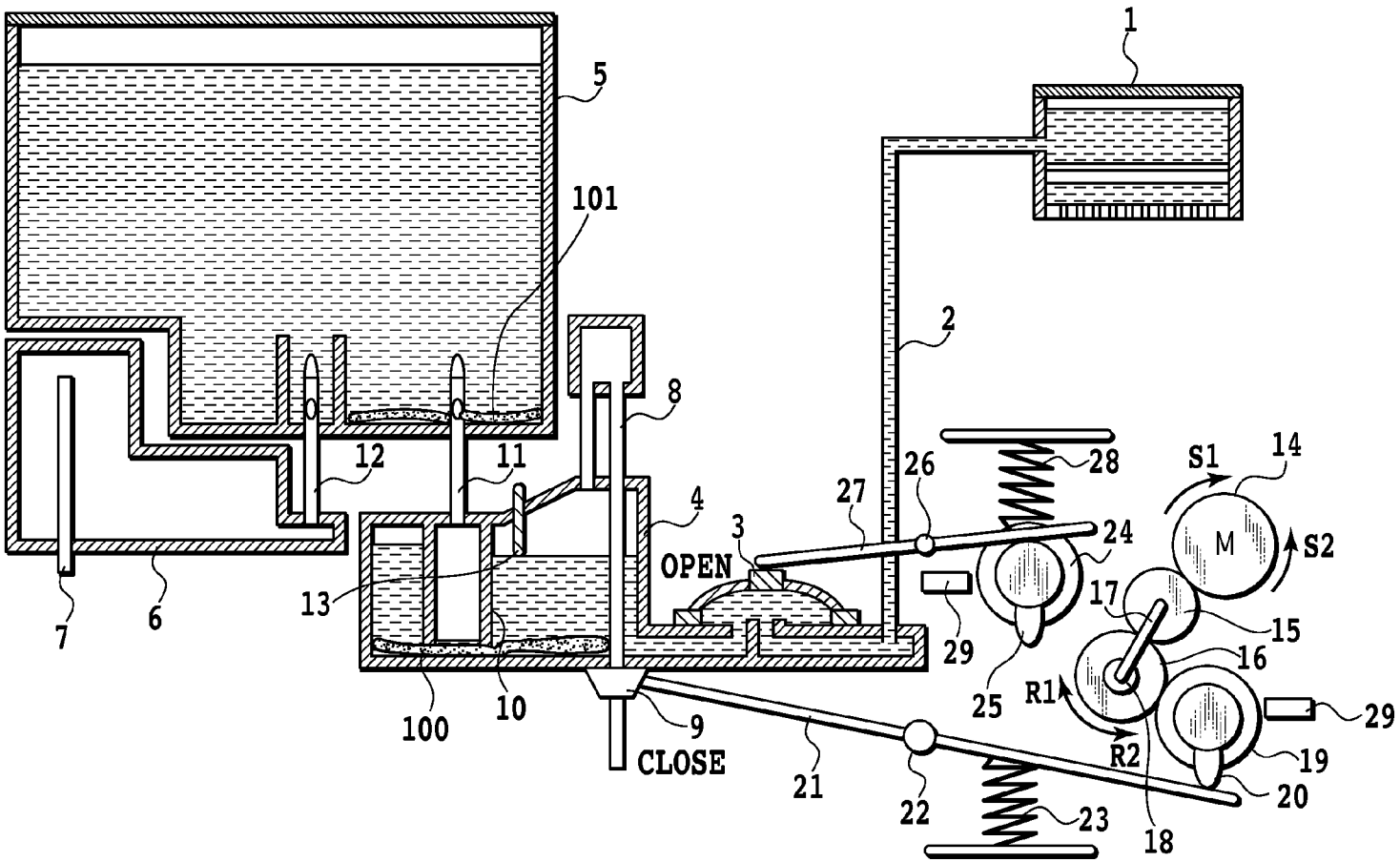
FIG. 11 is an explanatory view for explaining a state of sedimentation of a coloring material component at a bottom of the ink tank.

FIG. 11 shows a state where the sub tank 4 is almost filled with the ink. Here, there are sediment portions 100 and 101 respectively at bottoms of the sub tank 4 and the main tank 5. Although the degree of sedimentation depends on the type of the ink used, a pigment component, more specifically a green pigment, is most likely to cause sedimentation. In the following, an example for dealing with a case of using the ink, which is most likely to cause sedimentation of the coloring material component in the state as illustrated in FIG. 11, will be described. Here, in the state shown in FIG. 11, the internal volume of the diaphragm portion 3 is assumed to be W1=0.5 cc while the internal volume of the sub tank 4 is assumed to be W2=20 cc. Accordingly, a ratio between the two internal volumes is 1:40, and is relatively high.

Figure 12:
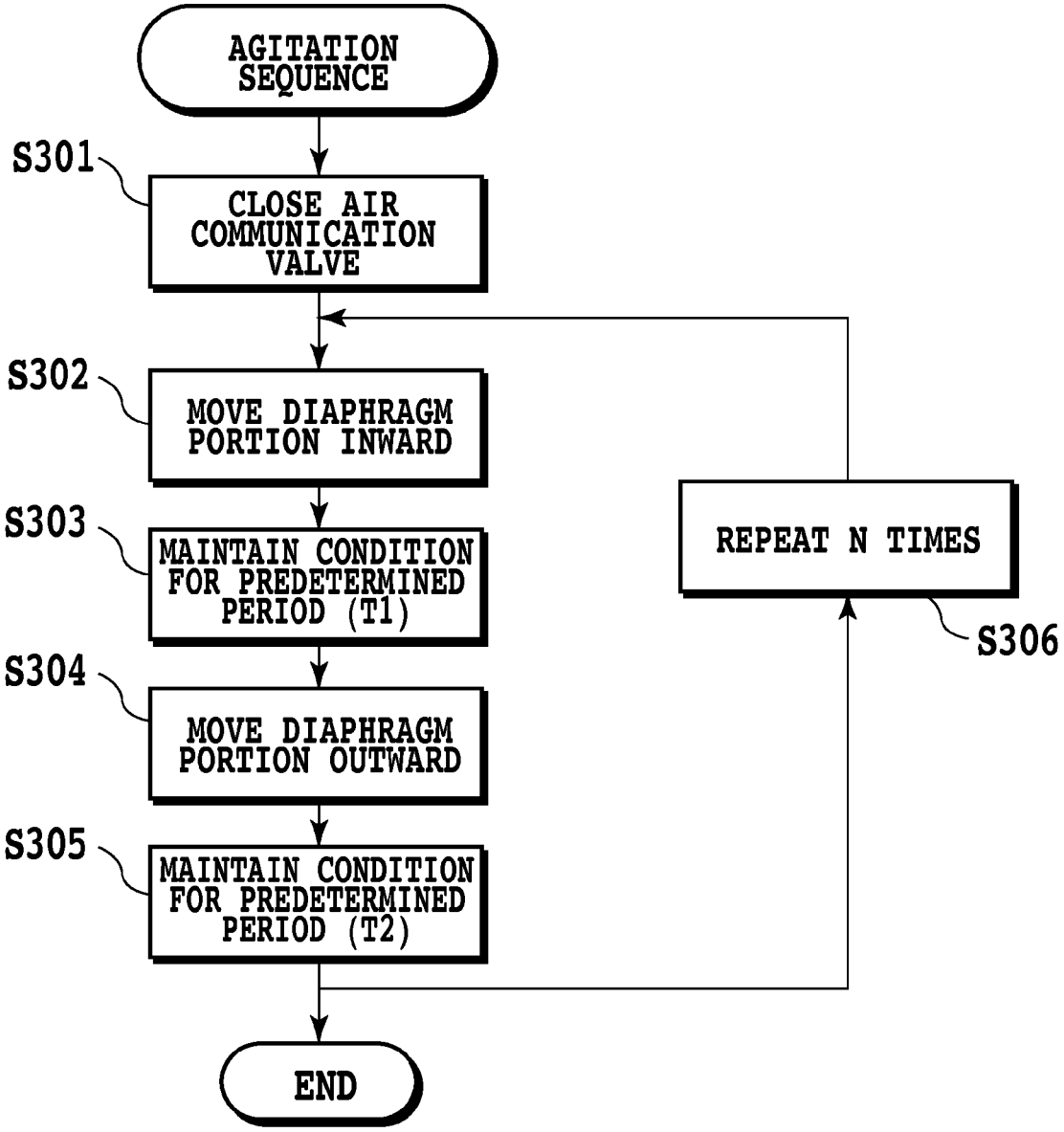
FIG. 12 is a flowchart showing an example of sequences for carrying out an agitating operation according to a characteristic configuration of the embodiment of the present invention.

FIG. 12 shows an example of steps for executing agitation. A control program corresponding to the steps may be stored in the ROM 121 and executed by the CPU 120 in the control system shown in FIG. 9.

Figure 13:
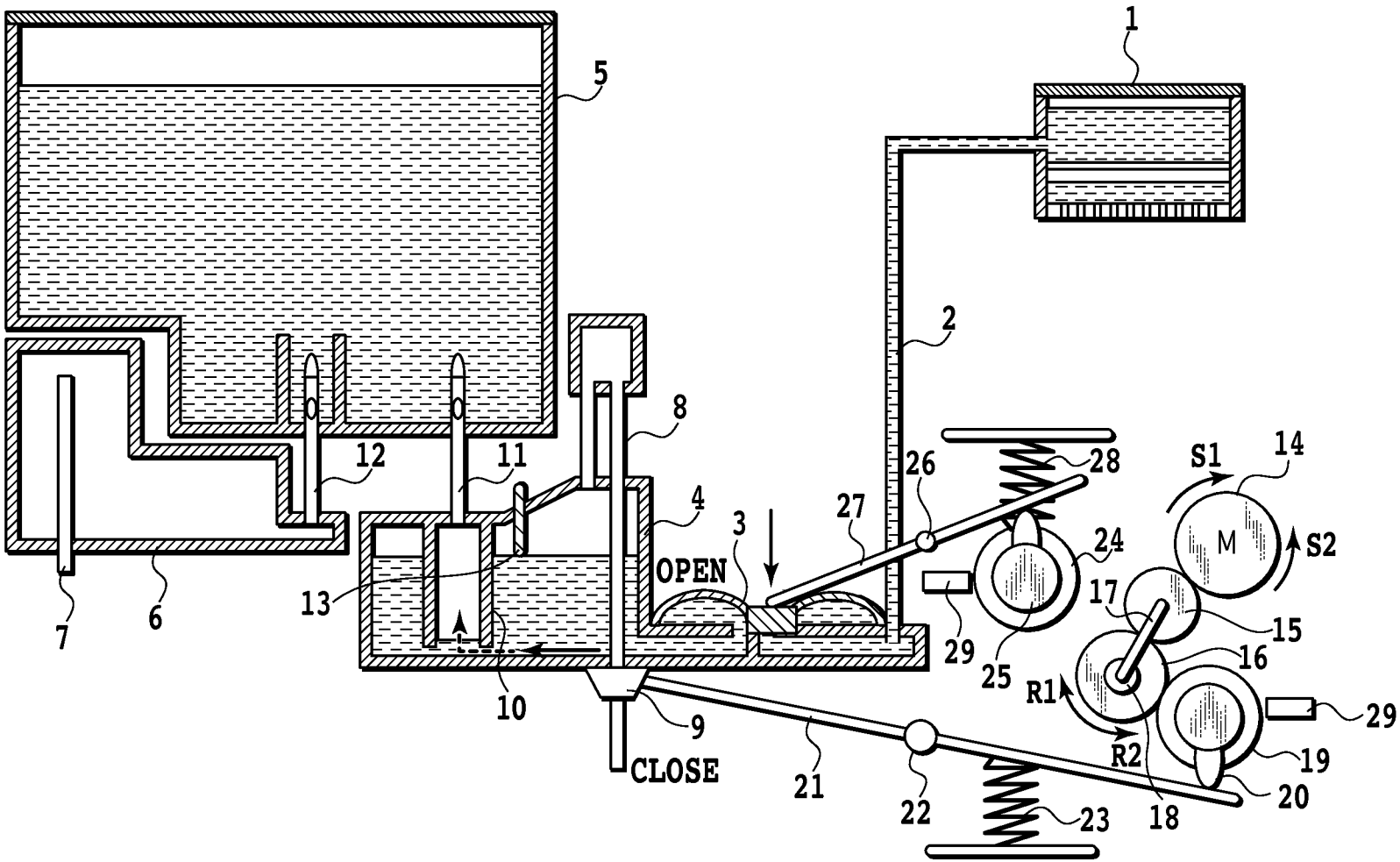
FIG. 13 is an explanatory view for explaining the agitating operation for eliminating sedimentation of the coloring material component at the bottom of the ink tank according to the characteristic configuration of the embodiment of the present invention.

In the agitation process, the air communication port 8*a* serving as an outlet of the air communication path 8 is firstly set to the closed state as shown in FIG. 11 by moving the air communication valve 9 (step S301 in FIG. 12). In this state, the diaphragm portion 3 is moved inward (step S302) and this condition is maintained for a predetermined period (step S303). When the flow resistance between the sub tank 4 and the diaphragm portion 3 is smaller than the flow resistance between the diaphragm portion 3 and the head 1, the ink pumped out of the diaphragm portion 3 swiftly flows into the bottom part of the sub tank 4 as shown in FIG. 13. As a result, the sediment portion 100 of the ink coloring material component at the bottom of the sub tank 4 is stirred up, and the sub tank is thereby agitated.

Figure 14:
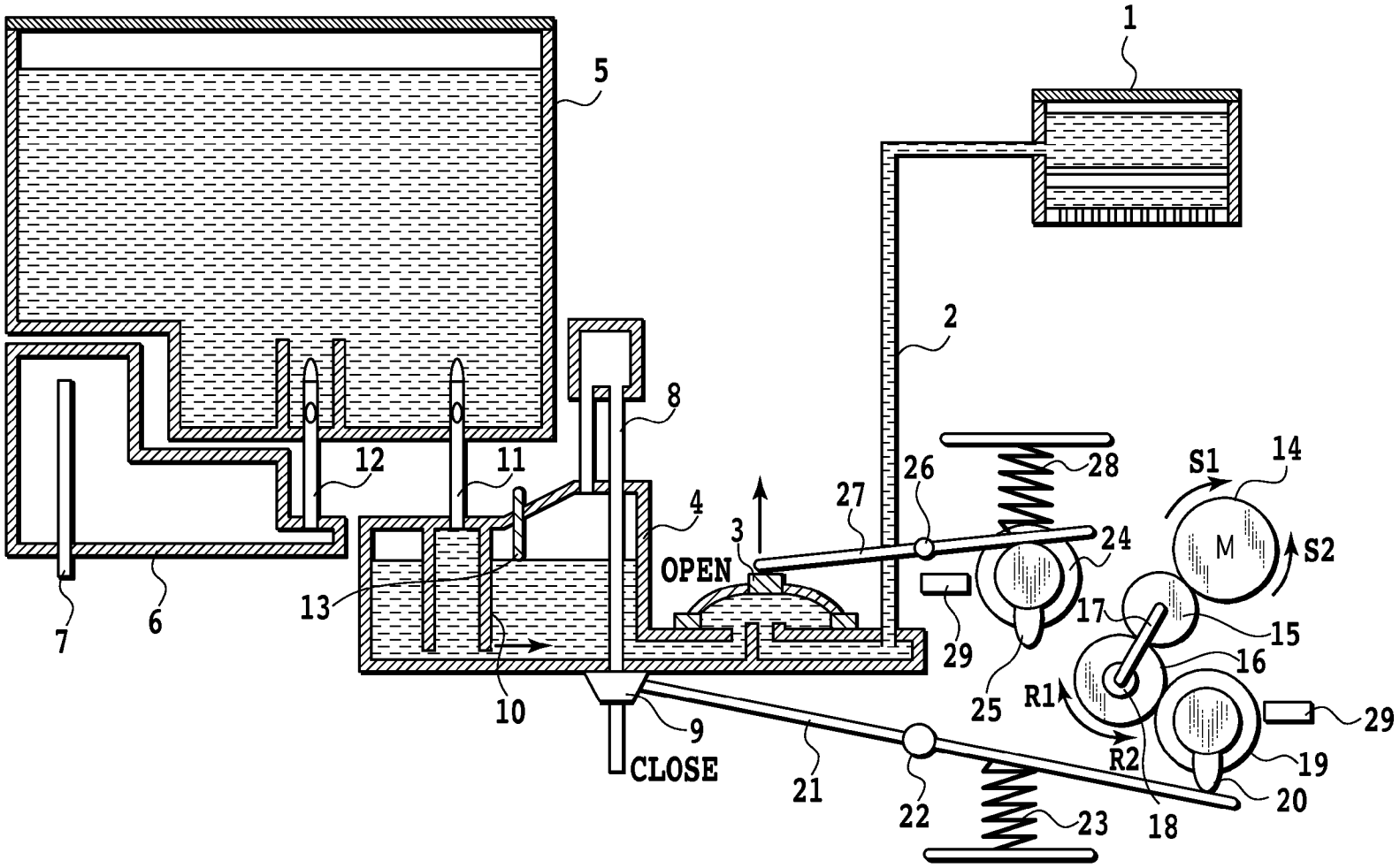
FIG. 14 is an explanatory view for explaining the agitating operation for eliminating sedimentation of the coloring material component.

Next, the diaphragm portion 3 is restored (step S304) and this condition is maintained for a predetermined period (step S305). Then, as shown in FIG. 14, the ink at the bottom of the sub tank 4 is drawn toward the diaphragm portion 3. The above-described operations of the diaphragm portion 3 are repeated for an appropriate number of times depending on the condition (step S306), thereby generating bidirectional flow of the ink between the bottom of the sub tank 4 and the diaphragm portion 3. Accordingly, it is possible to eliminate the sediment portion 100 inside the sub tank 4 used for supplying the ink directly to the printing head. As for a condition to determine the number of times of operations to be repeated, the type of the coloring material used in the ink or an interrupted period of the printing operation may be considered.

Although the agitating operation to be executed while closing the air communication port 8*a* has been described above, it is needless to say that a desired effect can also be obtained while opening the air communication port 8*a* by optimizing the control condition of the diaphragm portion 3.

Figure 15:
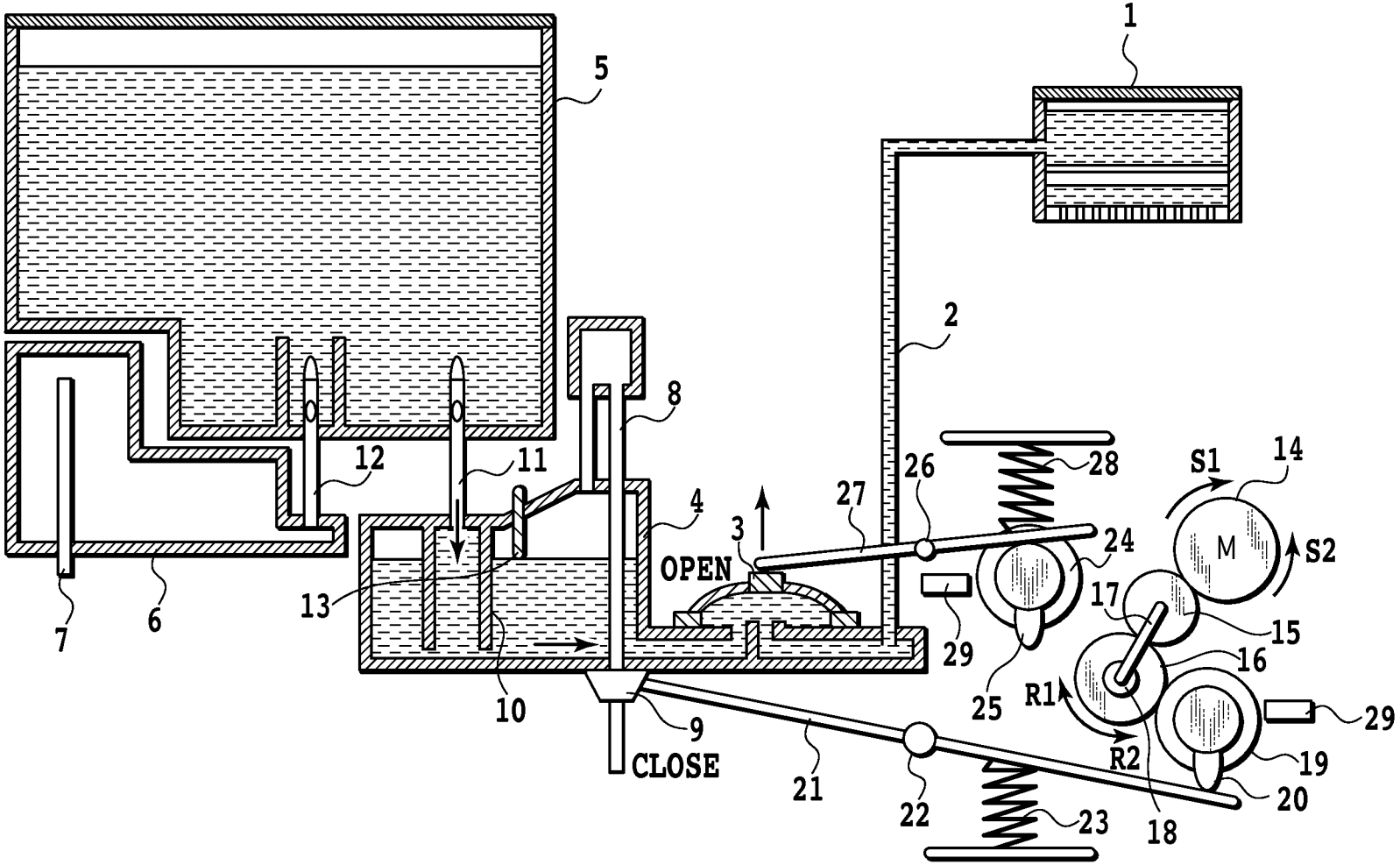
FIG. 15 is an explanatory view for explaining the agitating operation for eliminating sedimentation of the coloring material component.

Moreover, in the above description, the internal volume ratio between the diaphragm portion 3 and the sub tank 4 is relatively large. Nevertheless, it is possible to further improve the effect of agitation when such an internal volume ratio is set to a relatively low level. Specifically, as an example, the internal volume of the diaphragm portion 3 is assumed to be W1=0.5 cc while the internal volume of the sub tank 4 is assumed to be W2=10 cc, and the internal volume ratio is defined as 1:20 which is relatively low. In this case, deformation of the diaphragm has a larger effect on the sub tank 4. Therefore, the flow of the ink is not limited within the bottom part of the sub tank 4 if a sum of the flow resistance from the diaphragm portion 3 to the sub tank 4 and the flow resistance from the sub tank 4 to the main tank 5 is smaller than the flow resistance between the diaphragm portion 3 and the head 1. That is, when executing the sequence as shown in FIG. 12, the flow reaches the ink sediment portion 101 at the bottom of the main tank 5 via the first hollow pipe 11 as indicated by a dashed arrow in FIG. 13. Specifically, along with the inward movement of the diaphragm portion 3, as shown in FIG. 13, the ink at the bottom of the sub tank 4 reaches the bottom of the main tank 5 via the first hollow pipe 11, and stirs up the sediment portion 101 at the bottom of the main tank 5, thereby agitating the inside of the main tank. Along with the restoring action of the diaphragm thereafter, as shown in FIG. 15, the ink at the bottom of the main tank 5, together with the ink at the bottom of the sub tank 4, will be drawn toward the diaphragm portion 3. As described above, by generating the bidirectional flow of the ink between the bottom of the main tank 5 and the diaphragm portion 3, it is possible to eliminate both of the sediment portions 100 and 101.

Figure 16:
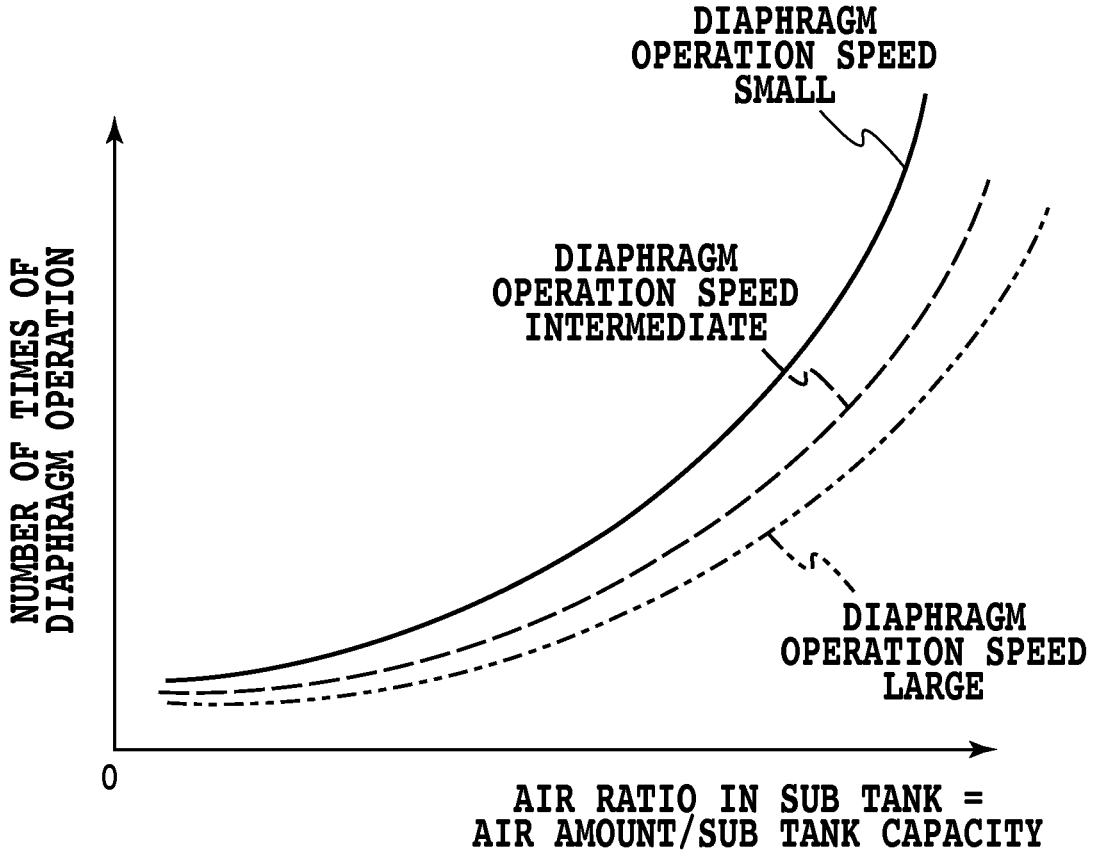
FIG. 16 is an explanatory graph for explaining data which is referenced in order to carry out an appropriate agitating operation according to an amount of air inside the sub tank.

Although the above description has been made on the assumption that the sub tank 4 is almost filled with the ink, it is also conceivable that the residual amount of the ink inside sub tank 4 may be reduced as shown in FIG. 16. Even if the sequence as shown in FIG. 12 takes place in this condition, there is a possibility of reduction in the pumping force of the ink attributable to the movement of the diaphragm portion 3 due to large amount of the air existing in the sub tank 4. In this case, it is difficult to send the ink to the bottom of the main tank 5 or even to the bottom of the sub tank 4, and efficiency of agitation is degraded. Accordingly, in this case, the sequence shown in FIG. 12 should be carried out after executing the operation to fill the sub tank 4 with the ink as described in conjunction with the basic configuration, i.e., after performing the sequence as shown in FIG. 8, and supplying sufficient amount of the ink into the sub tank 4.

Moreover, the above-described examples of performing the agitating operation are described respectively in the case where the sub tank 4 is almost filled with the ink and in the case where there is only a little amount of the ink left in the sub tank 4. In other cases, such as a case where the amount of the ink inside the sub tank 4 is intermediate, the present invention can be effectively applied also. Specifically, conditions for obtaining an appropriate agitating effect may be variably set up based on the amount of the air and the amount of the ink inside the sub tank 4 and depending on an amount of change in volume due to the operation of the diaphragm portion 3 and on the above-described internal volume ratio. Such conditions may include at least one of a period when the flow of the ink is absent due to interruption of the printing operation, a speed of inward/outward displacement of the diaphragm portion 3 (the movement of the diaphragm), the number of repeated times of the movements, and the type of the ink. In addition, the conditions may include determination on whether to perform the filling operation before the agitating operation. In this way, it is possible to eliminate the sediment portion 101 at the bottom of the main tank 5 as well as the sediment portion 100 at the bottom of the sub tank 4, and to perform efficient agitation in a short period.

In these cases, it is possible to calculate the amount of the air and the amount of the ink inside the sub tank as follows, for example. Specifically, as described previously, by judging the presence or absence of electrical conduction between the solid rod 13 and the hollow pipe 11, it is possible to find out the state where the sub tank 4 is substantially filled with the ink, the state where no ink is practically left in the main tank 5, and the state where the main tank 5 is not attached. Here, an amount of the ink used for printing is calculated, since the time when the state changes from that the electrical conduction is confirmed to that the electrical conduction is not confirmed because there is virtually very little amount of ink in the main tank 5 or because the main tank 5 is not attached. The air replaces the ink by an amount corresponding to the used amount of ink in the sub tank 4. Thus it is possible to calculate the amount of the air. Meanwhile, the amount of the ink can be calculated by counting the number of dots ejected from the printing head 1 and then multiplying the number of dots by an amount of ink ejection per dot, for example. Then, as shown in FIG. 16, data representing a correlation between the amount of the air and the effect of agitation are stored in the ROM 121, for example, and are used for reference. In this way, it is possible to determine the optimum agitating condition promptly. Moreover, a special mechanism for detecting the amount of the ink inside the sub tank 4 or and time for detection are unnecessary. Hence it is possible to achieve the highly efficient inkjet printing apparatus with a simple structure.

Figure 17:
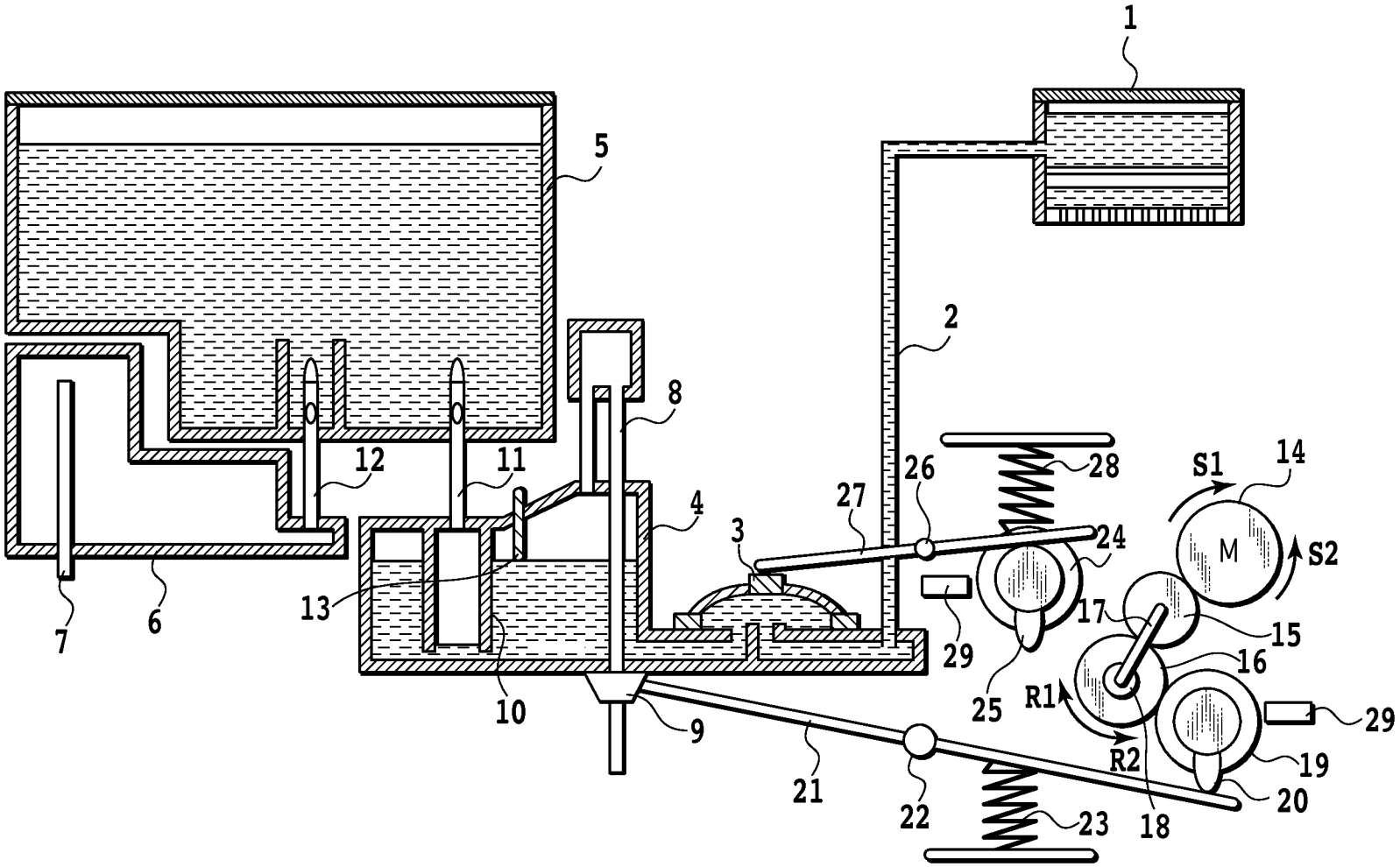
FIG. 17 is an explanatory view showing a state where a small-capacity main tank is mounted.

Moreover, the present invention is applicable regardless of the capacity of the main tank while using the ink supply system with the same structure on the body of the printing apparatus, for example in the case of allowing the attachment of a small-capacity main tank 51 as shown in FIG. 17. In this case, the capacity of the attached main tank can be recognized by causing the body of the printing apparatus to analyze identification information stored in a storing medium such as an IC chip, which is embedded on the main tank, for example. It is possible to perform appropriate operations to agitate the sub tank and the main tank efficiently based on the information on the capacity of the attached main tank and the conditions of the ink inside sub tank 9.

(Others)

The embodiment has been described above based on the case of applying the present invention to the inkjet printing apparatus of the so-called serial scanning type. However, the present invention is also applicable to an inkjet printing apparatus of a so-called full line type that uses a printing head with ejection openings arranged across an entire range in a width direction of a printing medium.

Moreover, in the above-described embodiment, the diaphragm portion is the member to cause the volume change. However, it is also possible to use a member other than the diaphragm as long as such a member is capable of performing the operations described above by displacement or deformation. For example, it is possible to apply bellows to the present invention.

Further, in the above-described embodiment, the ink containing the pigment component (i.e., the pigment ink) has been used as the example of the ink which is apt to cause the sediments of the coloring material component. However, it is also effective to apply the present invention to a system which uses a so-called dye ink that contains a dye as the coloring material component. Specifically, when the ink gets frozen in cold climates, for example, ingredients of the ink may be separated in the freezing process. In this case, the dye may be locally located inside the ink tank from time to time. As a consequence the dye ink is also apt to cause a concentration gradient though such a gradient may be less significant than the case of the pigment ink.

Furthermore, the embodiment has described of the case of executing the agitation sequence in the state of closing the air communication valve 9, i.e., after establishing a hermetically sealed state of the ink supply system. This configuration is effective in order to extend the agitating effect caused by the ink flow to the main tank. However, there may also be a case where it is only necessary to agitate the sub tank or where it is necessary to avoid a back flow of the ink through the hollow pipe 11, such as when the main tank is empty or when the main tank is detached. In such a case, it is also possible to execute the agitation sequence after setting the air communication valve 9 to the opened state.

In addition, in the above-described embodiment, the conditions in order to achieve the appropriate effect of agitation are set up in accordance with the amount of the ink and the amount of the air inside the sub tank. However, it is possible to consider the amount of the ink and the amount of the air inside the main tank instead or in addition thereto.

Furthermore, in the above-described embodiment, the main tank is designed to be replaceable, i.e., attachable and detachable from the body of the printing apparatus. Instead, the main tank may be fixed to the body of the apparatus. In this case, a refilling operation may be carried out by means of injection when the ink is empty.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-056901, filed Mar. 10, 2009, which is hereby incorporated by reference herein in its entirety.

What is claimed is:

1. An inkjet printing apparatus comprising:

a first ink tank configured to contain an ink to be supplied to a printing head performing printing by ejecting the ink;

a second ink tank located between the first ink tank and the printing head and configured to temporarily store the ink to be supplied from the first ink tank to the printing head;

an air communication valve capable of opening and closing a communicating portion allowing an inside of the second ink tank to communicate with the atmosphere;

a variable volume member located in an ink supply path between the second ink tank and the printing head and being capable of changing an internal volume thereof; and a driving mechanism configured to drive the air communication valve to thereby open and close the air communication valve, and to drive the variable volume member to thereby generate a change in the internal volume thereof, wherein in the ink supply path, a resistance value of a flow path from the variable volume member to the printing head is greater than a resistance value of a flow path from the variable volume member to the second ink tank, and the driving mechanism generates bidirectional flow of the ink between the variable volume member and the second ink tank by driving the air communication valve to open or to close the air communication valve and driving the variable volume member to change the internal volume thereof.

2. An inkjet printing apparatus as claimed in claim 1, wherein the driving mechanism drives the air communication valve to close the air communication valve and then drives the variable volume member to change the internal volume thereof, and the resistance value of the flow path from the variable volume member to the printing head is greater than a sum of the resistance value of the flow path from the variable volume member to the second ink tank and a resistance value of a flow path from the second ink tank to the first ink tank, thereby also allowing bidirectional flow of the ink to be generated between the first ink tank and the second ink tank.

3. An inkjet printing apparatus as claimed in claim 1, wherein the first ink tank is attachable and detachable.

4. An inkjet printing apparatus as claimed in claim 1, wherein the variable volume member includes a diaphragm capable of reducing the internal volume.

5. An inkjet printing apparatus as claimed in claim 1, wherein at least one of a speed and a frequency to change the internal volume of the variable volume member is set variably in accordance with a condition of the ink.

6. An inkjet printing apparatus as claimed in claim 1, wherein a condition of the ink is at least one of an amount of the ink and an amount of air in at least one of the first and second ink tanks, a type of the ink, and a period when a flow of the ink is absent.

7. An inkjet printing apparatus as claimed in claim 1, wherein a connecting portion where the second ink tank is connected to the flow path from the variable volume member to the second ink tank is located at a bottom of the second ink tank.

8. An inkjet printing apparatus as claimed in claim 1, wherein the ink includes a pigment as a coloring material component.

* * * * *